US006275674B1

(12) United States Patent
Sugimoto

(10) Patent No.: US 6,275,674 B1
(45) Date of Patent: Aug. 14, 2001

(54) DEVELOPING DEVICE, AND IMAGE FORMING APPARATUS USING THE SAME

(75) Inventor: Katsumi Sugimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/580,099

(22) Filed: May 26, 2000

(30) Foreign Application Priority Data

Oct. 15, 1999 (JP) ..... 11-294245

(51) Int. Cl.[7] ..... G03G 15/08
(52) U.S. Cl. ..... 399/254; 399/256
(58) Field of Search ..... 399/254, 255, 399/256, 285

(56) References Cited

U.S. PATENT DOCUMENTS 5,485,244 1/1996 Gotoda et al. .
5,581,337 12/1996 Suzuki .
5,659,859 * 8/1997 Kikuta et al. ..... 399/256

FOREIGN PATENT DOCUMENTS 54-99630 7/1979 (JP) .
60-133483 7/1985 (JP) .
61-57965 * 3/1986 (JP) .
62-25776 2/1987 (JP) .
62-30272 2/1987 (JP) .
62-67569 * 3/1987 (JP) .
4-100074 4/1992 (JP) .
4-165379 * 6/1992 (JP) .
6-51574 2/1994 (JP) .
6-337590 12/1994 (JP) .
7-50754 11/1995 (JP) .

* cited by examiner

*Primary Examiner*—Susan S. Y. Lee
(74) *Attorney, Agent, or Firm*—Armstrong, Westerman, Hattori, McLeland & Naughton LLP

(57) ABSTRACT

In an image forming apparatus, a developing device includes a stirring and conveying screw of electrically conductive material to stir and convey toner along a toner delivery path, a toner gathering port located in the toner delivery path to temporarily stay the toner there during the conveying, an auxiliary stirring member of electrically conductive material movably held in the toner gathering port, and a stop located at the toner gathering port to prevent the auxiliary stirring member from being removal off the toner gather port and to allow the toner to pass the toner gathering port. The stirring and conveying member and the auxiliary stirring member are charged electricity by an bias voltage applied to the developing device so that the toner can be fully stirred and, at the same time, can be electrically charged uniformly with an increased amount of charges.

25 Claims, 14 Drawing Sheets

DEVELOPING DEVICE, AND IMAGE FORMING APPARATUS USING THE SAME

BACKGROUND OF THE INVENTION

1. Field of the Invention

This invention relates to a developing device and an image forming apparatus which are particularly useful when used in a xerographic printing machine in which a latent image formed on an image supporting body is developed into a visible image as a toner is applied to the image supporting body over the latent image.

2. Description of Related Art

In a xerographic printing machine, a printing process begins with exposing an electrically charged photosensitive image supporting body (hereinafter also called the photosensitive drum) to light in a pattern of print to form a latent image on a circumferential surface of the photosensitive drum. In the meantime, a two-component developer in a mixture of toner and magnetic powder (carrier) is delivered to a circumferential surface of a developing roller to form a layer of the developer in a suitable thickness on the circumferential surface of the developing roller; the latent image formed on the photosensitive drum is developed into a visible image with the toner as the developing roller is rotated in the vicinity of the circumferential surface of the photosensitive drum.

Then the toner of the visible image on the circumferential surface of the photosensitive drum is transferred to a print sheet, whereupon the unfixed toner image on the print sheet is fixed to finalize the print process onto the print sheet.

In the developing device, a consumption of toner due to printing is calculated from the result of detection of a toner density sensor, a print density sensor, etc., and an amount of toner commensurate with the calculated consumption will be additionally supplied from a toner hopper into the developing device.

The developing device is provided with a plurality of stirring and conveying screws or puddles (hereinafter also called the screws) which are disposed downwardly of a toner delivery port of the toner hopper and contiguously parallel to one another. As they rotate about their respective axes, the screws convey the developer while stirring the developer to mix the toner and carrier with each other.

During the conveying and stirring, the screws are charged with electricity of a bias voltage, opposite in polarity to that applied to the photosensitive drum, by the power source so that the developer (toner) is charged with electricity via the screws.

In a developer (toner) delivery path to the photosensitive drum, the amount of electrical charge of the developer (toner) should usually exceed a predetermined value until it reaches the developing roller.

FIG. 14 is a graph showing an example of distribution of amount of electrical charge of a developer in the printing machine; the developer (00403/J5) shown in FIG. 14 was such that the most largest part of toner was charged in approximately 1.5 fC/$\mu$m.

The developing roller includes a fixed magnet, in the form of an axle having a plurality of conveying magnetic poles, and a rotary sleeve, in the form of a hollow tube of non-magnetic material such as aluminum alloy, which is rotatably disposed around the fixed magnet; the sleeve is driven for rotation to convey a developer and also attracts the developer onto a circumferential surface of the sleeve while conveying.

Further, the developing roller is disposed in a parallel confronting relationship to the photosensitive drum with a small gap therebetween. At a position upstream of the developing region of the photosensitive drum, the developing roller receives the stirred and mixed developer from adjacent developer conveying rollers and the screws.

Thus the two-component developer is conveyed as the toner delivered from the toner hopper is stirred and mixed with the carrier by the stirring and conveying screws or puddles, during which the developer is charged up to a predetermined amount of electrical charge. The resulting developer is then transferred to the developing roller directly or via the developer conveying rollers.

The transferred developer on the developing roller is conveyed with rotation of the sleeve of the developing roller and is then restricted in amount (thickness of the developer layer) on the circumferential surface of the developing roller to a constant value by a restricting member. After that, only toner in the developer adheres to a latent image on the photosensitive drum to develop the latent image into a visible image.

In the meantime, the carrier in the developer keeps staying on the sleeve of the developing roller even after this developing on the photosensitive drum and is hence conveyed back into the developing device, whereupon the carrier is released from the developing roller, is then collected and is again stirred and mixed with fresh toner from the toner hopper by the screws.

In order to facilitate stirring and mixing toner with carrier by the screws, it has been customary to make toner particles round. And in order to prevent cohesion of toner, it has been also customary to add an additive to toner.

In the foregoing example, the two-component developer, which is composed of toner and carrier, was used. Alternatively a single-component developer, which is composed of only toner, may be used.

In recent years, as many of printing machines are often installed in offices rather than homes, demands for speeding and downsizing the printing machines are on the rise. Particularly in the above-mentioned xerographic printing machine, the developing process causing toner to stick to the photosensitive drum is important as being influential on improving the print quality and increasing the printing speed.

For achieving high-speed developing, it is necessary to carry out stirring and charging of toner at high speed; if the ability of stirring and charging toner is lowered with respect to printing speed, print faults, such as cohesion of toner particles and blurring would be encountered with printing, lowering the print quality.

Further, for increasing the printing speed, an improved developing device is known in which a developer is preliminarily stirred before being delivered to the stirring and conveying screws for further stirring. However, this developing device must be equipped with a mechanism dedicated for preliminary stirring, which would increase the entire device size.

Another improved developing device is known for crushing the cohered toner into small particles using a stirring member with projections. With this improved developing device, however, as the printing (developing) speed is increased, it would be impossible to electrically charge the toner sufficiently, thus resulting in occurrence of blurs in printing.

SUMMARY OF THE INVENTION

With the foregoing problems in view, it is an object of the present invention to provide a developing device in which toner is sufficiently stirred and charged while being conveyed along a toner delivery path.

Another object of the invention to provide an image forming apparatus in which the developing device described in the previous paragraph is incorporated.

According to a first inventive concept, the above first-named object is accomplished by a developing device for developing a latent image, which is formed on an image supporting body, into a visible image, the device comprising: a toner source; at least one stirring and conveying member of an electrically conductive material, extending between the toner source and the image supporting body, for conveying a toner from the toner source to the image supporting body longitudinally along a toner delivery path and stirring the toner being conveyed, the stirring and conveying member being electrically charged by a bias voltage to be applied during the developing and hence also serving to charge the toner with electricity during the stirring; at least one toner gathering port, disposed in the toner delivery path, for temporarily halting the toner there during the conveying; at least one auxiliary stirring member of an electrically conductive material, movable in the toner gathering port, for further stirring the toner staying in the gathering port, the auxiliary stirring member being electrically charged by the bias voltage and hence also serving to further charge the toner with electricity during the further stirring; and a stop, disposed at the toner gathering port, for preventing the auxiliary stirring member from moving off the toner gathering port and for allowing the toner to pass through the toner gathering port.

According to a second inventive concept, the above second-named object is accomplished by an image forming apparatus comprising: an image supporting body on which a latent image is to be formed based on given image information; a toner source; a developing unit for developing the latent image, which is formed on the image supporting body, into a visible image using a toner delivered from the toner source; a transferring unit for transferring the toner of the image, which is developed on the image supporting body, onto a medium; and a power source for applying to the developing unit a bias voltage for development. The developing unit includes: at least one stirring and conveying member of an electrically conductive material, extending between the toner source and the image supporting body, for conveying a toner from the toner source to the image supporting body longitudinally along a toner delivery path and stirring the toner being conveyed, the stirring and conveying member being electrically charged by a bias voltage to be applied during the developing and hence also serving to charge the toner with electricity during the stirring; at least one toner gathering port, disposed in the toner delivery path, for temporarily halting the toner there during the conveying, at least one auxiliary stirring member of an electrically conductive material, movable in the toner gathering port, for further stirring the toner staying in the gathering port, the auxiliary stirring member being electrically charged by the bias voltage and hence also serving to further charge the toner with electricity during the further stirring; and a stop, disposed at the toner gathering port, for preventing the auxiliary stirring member from moving off the toner gathering port and for allowing the toner to pass through the toner gathering port.

With the developing device and the image forming apparatus of the first and second inventive concepts, since cohered toner is crushed into small particles by the action of auxiliary stirring member in the toner gathering port, it is possible to improve the stirring performance and the image quality as well. And since toner also is charged with electricity via the stirring and conveying member and the auxiliary stirring member, it is possible to improve the ability of charging so that toner charging time can be reduced to increase the developing speed and hence the printing speed. It is also possible to reduce the entire device or apparatus size.

As a preferred feature, the stirring and conveying member includes a shaft extending along the toner delivery path and operatively connected to a drive source for rotation, and a spiral blade extending on and around the circumferential surface of the shaft. The spiral blade may have a cut-out portion defining the toner gathering port around the circumferential surface of the shaft.

As another preferred feature, the stirring and conveying member includes a shaft extending along the toner delivery path and operatively connected to a drive source for rotation, and at least two continuous spiral blades extending on and around the circumferential surface of the shaft, each of the spiral blades being spaced a predetermined distance from an adjacent one of the spiral blades axially of the shaft to define the toner gathering port around the circumferential surface of the shaft.

Having the foregoing respective preferred feature, each of the developing device and the image forming apparatus is advantageous in that it enables to facilitate providing the toner gathering port, thereby reducing the cost of manufacture and guaranteeing sure stirring and charging of toner at the toner gathering port.

As still another preferred feature, the stop surrounds the toner gathering port around the circumferential surface of the shaft. The stop movably holds the auxiliary stirring member within the toner gathering port, guaranteeing sure stirring and charging of toner at the toner gathering port. The stop also facilitates providing the stirring and conveying member and hence reduces the cost of manufacture.

As a further preferred feature, the toner gathering port is divided into a plurality of segmental stirring chambers by a plurality of radial plates projecting from the circumferential surface of the shaft of the stirring and conveying member, the auxiliary stirring member being movably held in at least one of said segmental stirring chambers. The arrangement guarantees sure stirring and charging of toner at the toner gathering port, and also facilitates providing the stirring and conveying member, thus reducing the cost of manufacture.

As a still further preferred feature, at least one toner gathering port is two or more toner gathering ports, each divided into a plurality of segmental stirring chambers by a plurality of radial plates projecting from the circumferential surface of said shaft of the stirring and conveying member. And at each toner gathering port, the auxiliary stirring member is movable in at least one of the segmental stirring chambers. And one of the segmental stirring chambers, with the auxiliary stirring member held therein, in an upstream one toner gathering port is located relative to one segmental stirring chamber, with the auxiliary stirring member held therein, in a downstream one toner gathering port in such a manner that part of the toner passed through the segmental stirring chambers other than the above-mentioned at least one segmental stirring chamber, in which the auxiliary stirring member is held, in the upstream one toner gathering port passes through the above-mentioned at least one segmental stirring chamber, in which the auxiliary stirring member is held, in the downstream one toner gathering port.

With this arrangement, since the toner failed to pass through the segmental stirring chamber, which holds the auxiliary stirring member in it, of the upstream toner gathering port and failed to be charged with electricity by the auxiliary stirring member, which is held in the segmental stirring chamber, can then be charged with electricity by the auxiliary stirring member, which is held in the segmental stirring chamber, of the downstream toner gathering port, it is possible to electrically charge the toner uniformly, thus improving the image quality.

As an additional preferred feature, at least one stirring and conveying member is two or more stirring and conveying members, the toner gathering port being disposed around the circumferential surface of an upstream one stirring and conveying member. With this arrangement, it is possible to stir and electrically charge the toner while stirring the toner by the upstream stirring and conveying member, thus improving the image quality.

As still additional preferred features, the auxiliary stirring member is spherical or cylindrical. Having such shaped auxiliary stirring member, it is possible to guarantee sure stirring and charging of toner at the toner gathering port without undesirably preventing passage of toner. Even when the stirring and conveying member is rotated, it is possible to reduce abrasions, vibrations and sounds that occur between the auxiliary stirring member, the stop and the radial plates at the toner gathering port.

According to a third inventive concept, the above first-named object is accomplished by a developing device for developing a latent image, which is formed on an image supporting body, into a visible image, the device comprising: a toner source; at least one stirring and conveying member of an electrically conductive material, extending between the toner source and the image supporting body, for conveying a toner from the toner source to the image supporting body longitudinally along a toner delivery path and stirring the toner being conveyed, the stirring and conveying member being electrically charged by a bias voltage to be applied during the developing and hence also serving to charge the toner with electricity during the stirring; at least one toner gathering port, disposed in the toner delivery path, for temporarily halting the toner there during the conveying; an annular casing surrounding the toner gathering port; and at least one auxiliary stirring member projecting from the annular casing into the toner gathering port.

According to a fourth inventive concept, the above second-named object is accomplished by an image forming apparatus comprising: an image supporting body on which a latent image is to be formed based on given image information; a toner source; a developing unit for developing the latent image, which is formed on the image supporting body, into a visible image using a toner delivered from the toner source; a transferring unit for transferring the toner of the image, which is developed on the image supporting body, onto a medium; and a power source for applying to the developing unit a bias voltage for development. The developing unit includes: at least one stirring and conveying member of an electrically conductive material, extending between the toner source and the image supporting body, for conveying a toner from the toner source to the image supporting body longitudinally along a toner delivery path and stirring the toner being conveyed, the stirring and conveying member being electrically charged by a bias voltage to be applied during the developing and hence also serving to charge the toner with electricity during the stirring; at least one toner gathering port, disposed in the toner delivery path, for temporarily halting the toner there during the conveying; an annular casing surrounding the toner gathering port; and at least one stirring and charging member projecting from the annular casing into the toner gathering port.

With the developing device and the image forming apparatus of the third and fourth inventive concepts, since the cohered toner is crushed by the stirring action of the auxiliary stirring member, it is possible to improve the stirring ability and hence the image quality. And since the toner is electrically charged via the stirring and conveying member and the stirring and charging member as well, it is possible to improve the charging ability so that the toner can be sufficiently charged with electricity in a reduced time, speeding the developing process and hence causing high-speed printing. In addition, it is possible to make the overall apparatus size smaller.

As yet another preferred feature, the auxiliary stirring member is in the form of at least one plate projecting from the casing in such a posture that the plate surface is at a predetermined angle with respect to the direction of toner flow in the toner gathering port. This feature enables efficient stirring and charging of toner.

DESCRIPTION OF THE PREFERRED EMBODIMENTS

Various embodiments of the present invention will now be described in detail with reference to the accompanying drawings.

(A) FIRST EMBODIMENT

Figure 6:
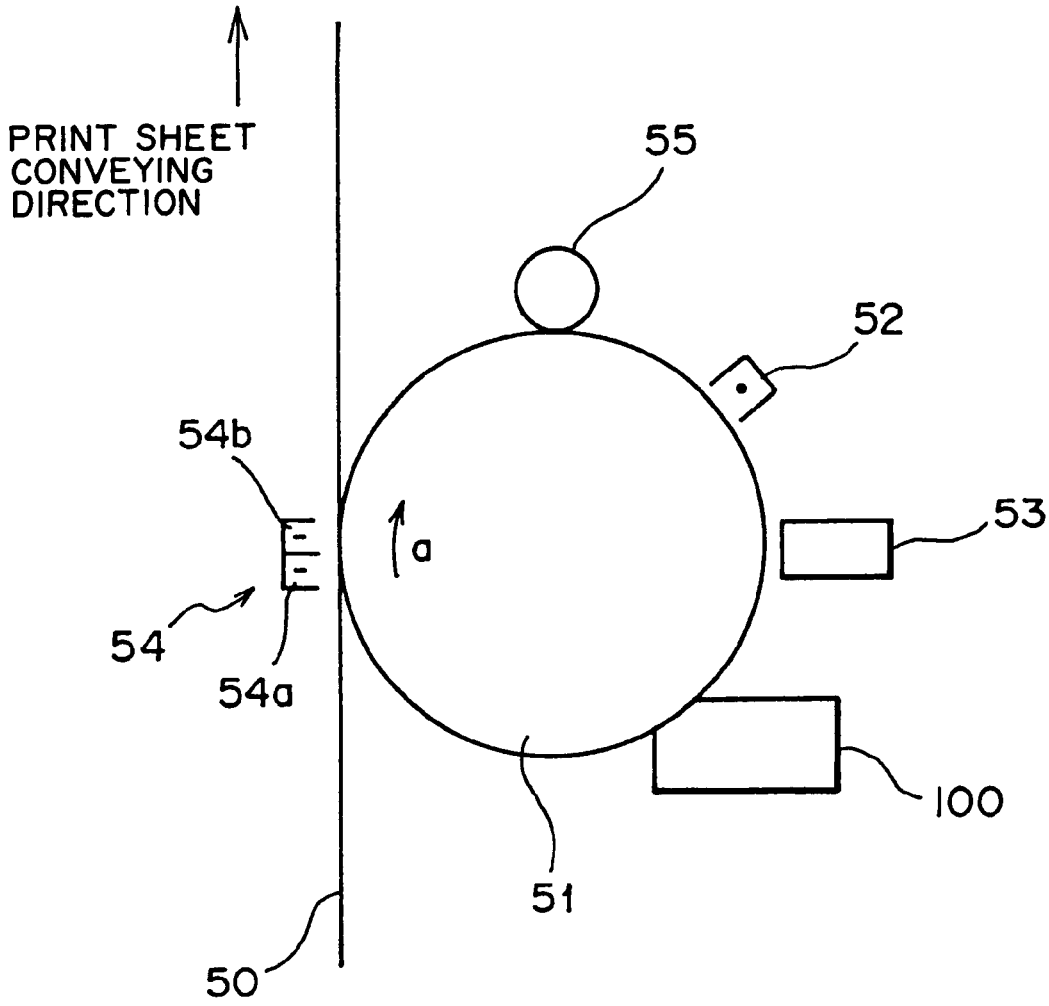
FIG. 6 is a side diagram schematically showing an image forming apparatus according to a second concept of the present invention.

FIG. 6 is a schematic side view showing an image forming apparatus according to a first embodiment of the present invention. In the image forming apparatus of the first embodiment, printing is carried out on a print paper sheet (hereinafter also called the medium) based on image information received from a higher-order apparatus such as a host computer.

The image forming apparatus comprises, as shown in FIG. 6, a photosensitive drum (hereinafter also called the image supporting body) 51, a developing unit (hereinafter also called the developing device) 100, a preliminary charger 52, an exposure unit 53, a transferring unit 54, a cleaning unit 55, and various other elements, such as an A.C. de-electrifier and an LED de-electrifier.

As the photosensitive drum 51 rotates in the direction of an arrow a in FIG. 6 in contact with a print paper sheet (medium) 50 during printing, a toner image (a pattern of electrical charges with toner adhered) is formed on a circumferential surface of the photosensitive drum 51, whereupon the toner of the image on the photosensitive drum 51 is transferred onto the print paper sheet 50 in the transferring unit 54 located adjacent to the circumferential surface of the photosensitive drum 51.

Downstream of the transferring unit 54 circumferentially about the photosensitive drum 51, the cleaning unit 55 is located for collecting residual waste toner, which stays on the photosensitive drum 51, using a brush or the like.

And downstream of the cleaning unit 55 circumferentially about the photosensitive drum 51, the preliminary charger 52 is located for electrically charging the circumferential surface of the photosensitive drum 51 uniformly as it is adjusted in charging voltage by a non-illustrated controller.

Further, the exposure unit 53 is located downstream of the preliminary charger 52 circumferentially about the photosensitive drum 51. The exposure unit 53 is an optical unit, e.g., in the form of an LED head, for irradiating a pattern of exposure light, which corresponds to an object image whose representation is to be printed, to the circumferential surface of the photosensitive drum 51 to form a latent image, in a pattern of charges, on the drum surface.

Likewise, downstream of the exposure unit 53 circumferentially about the photosensitive drum 51, the developing unit 100 is located for developing the latent image, which is formed on the photosensitive drum 51 by the exposure unit 53, into a visible image in a pattern of toner. For delivering toner to the photosensitive drum 51, the developing unit 100 is equipped with a non-illustrated toner source.

The photosensitive drum 51 is engageable with a print paper sheet 50 at a position downstream of the developing unit 100 circumferentially about the drum surface so that the toner of the image pattern on the photosensitive drum 51 is transferred onto the print paper sheet 50.

The transferring unit 54 includes a transfer charger **54*a* and a separation charger 54*b* and is located in confronting relation to the photosensitive drum 51 with a print paper sheet 50** interposed between them.

Concurrently with the time when the photosensitive drum 51 and the print paper sheet 50 come into contact with each other, the transfer charger **54*a* generates corona discharge at a potential of opposite polarity to the potential of charge of the toner image to electrically discharge the print paper sheet 50, thereby attracting/transferring the toner of the image from the photosensitive drum 51 to the print paper sheet 50**.

The separation charger **54*b* is located adjacently to and downstream of the transfer charger 54*a* in a traveling path of the print paper sheet 50 for electrically charging the print paper sheet 50 so as to cancel/remove existing charges of the print paper sheet 50 after the toner of the image has been transferred so that separation of the printing paper sheet 50 from the photosensitive drum 51** is facilitated.

With continued printing process, the circumferential surface of the photosensitive drum 51 having passed the transferring station where transferring took place reaches the cleaning unit 55 as the photosensitive drum 51 rotates in the direction of arrow $\alpha$. In the cleaning unit 55, as mentioned above, the residual waste toner is then cleared off the circumferential drum surface.

Additionally, the image forming apparatus is equipped with a non-illustrated fixing unit for heating the toner of the image transferred to the print paper sheet 1 into molten form to thereby fix the toner image.

Figure 1:
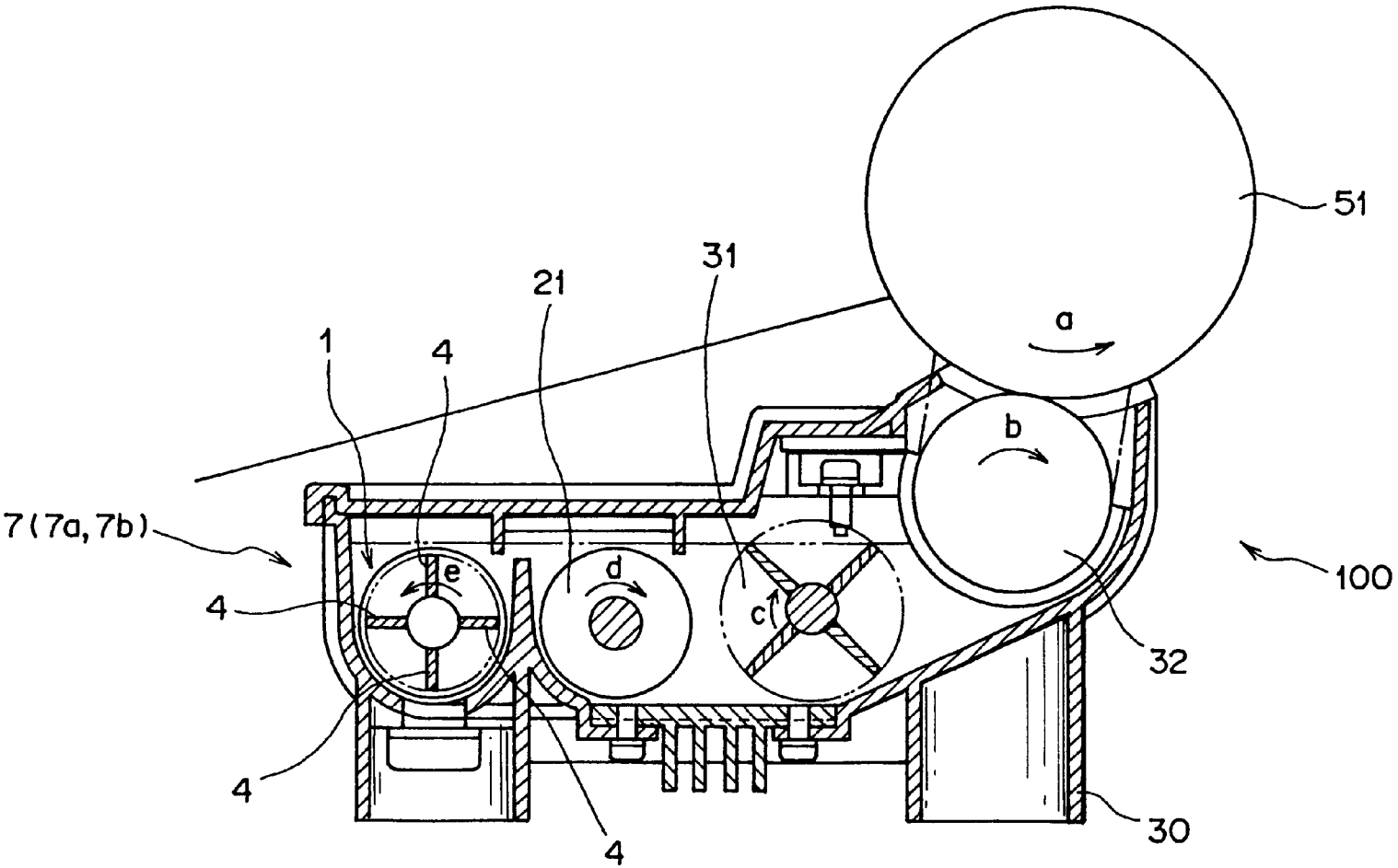
FIG. 1 is a cross-sectional view (taken along line A—A of FIG. 2) showing a developing device, of an image forming apparatus, according to a first concept of the present invention.
Figure 2:
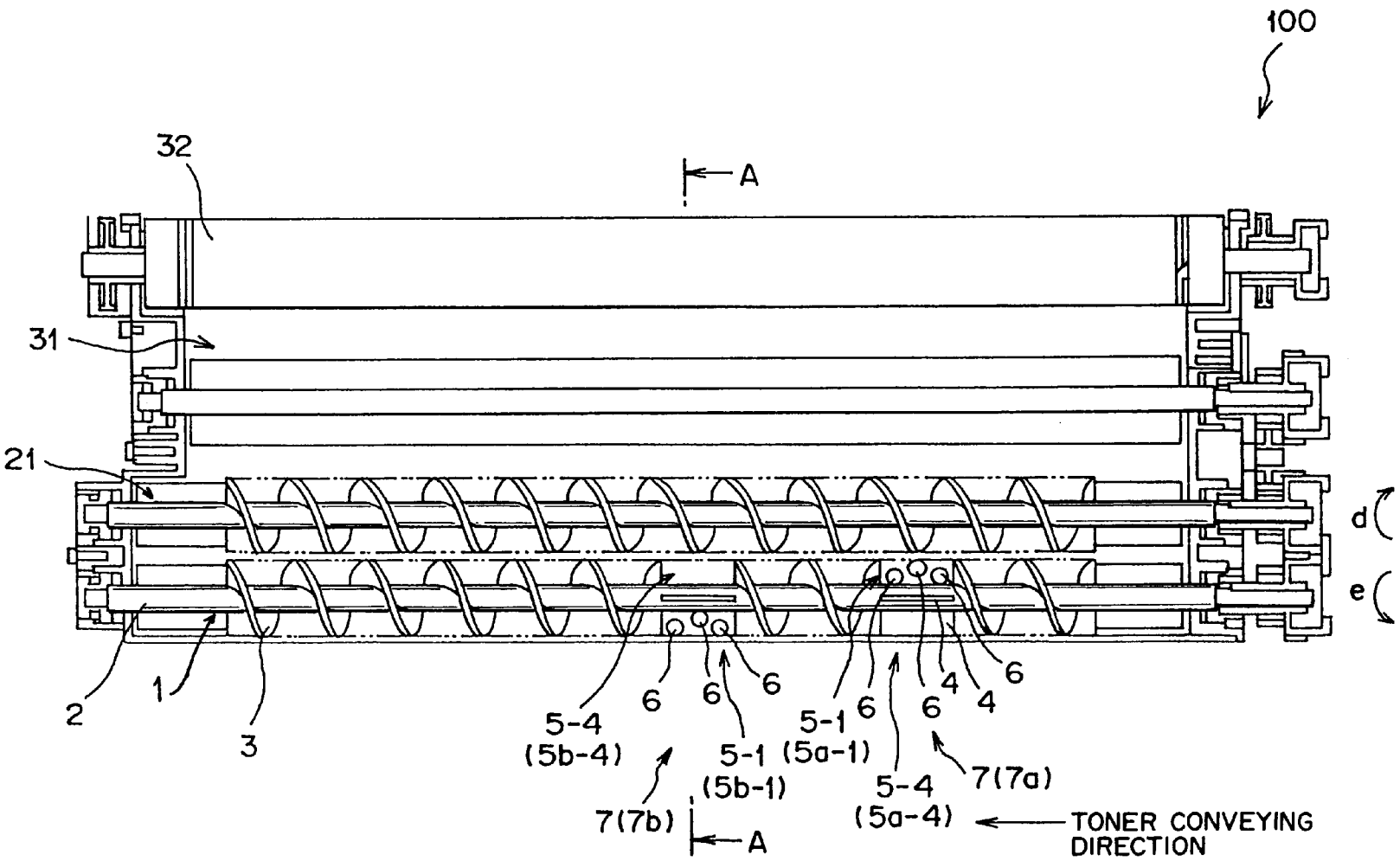
FIG. 2 is a plan view of the developing device of the first inventive concept.
Figure 3:
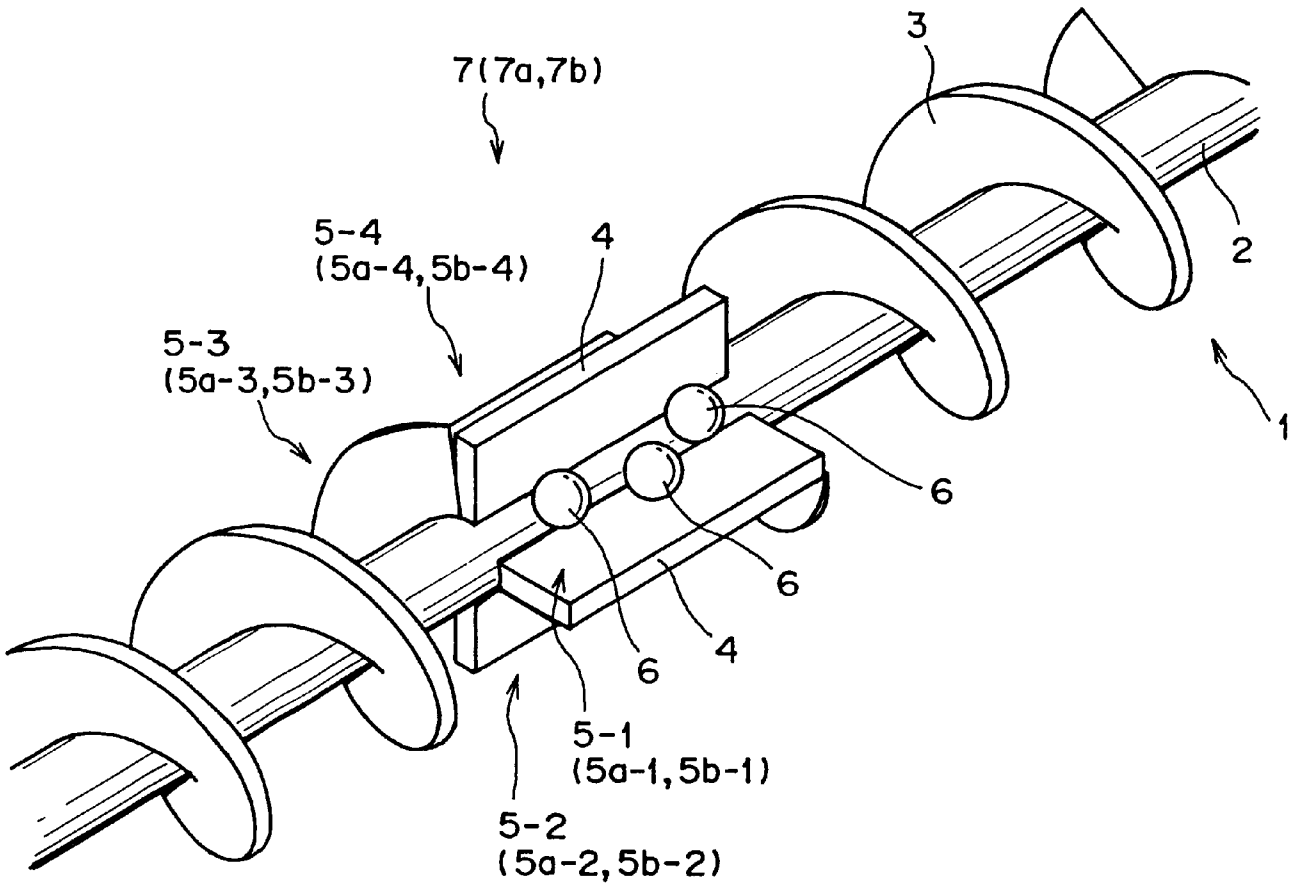
FIG. 3 is an enlarged, fragmentary perspective view showing a stirring and conveying screw of the developing device of the first inventive concept.
Figure 4:
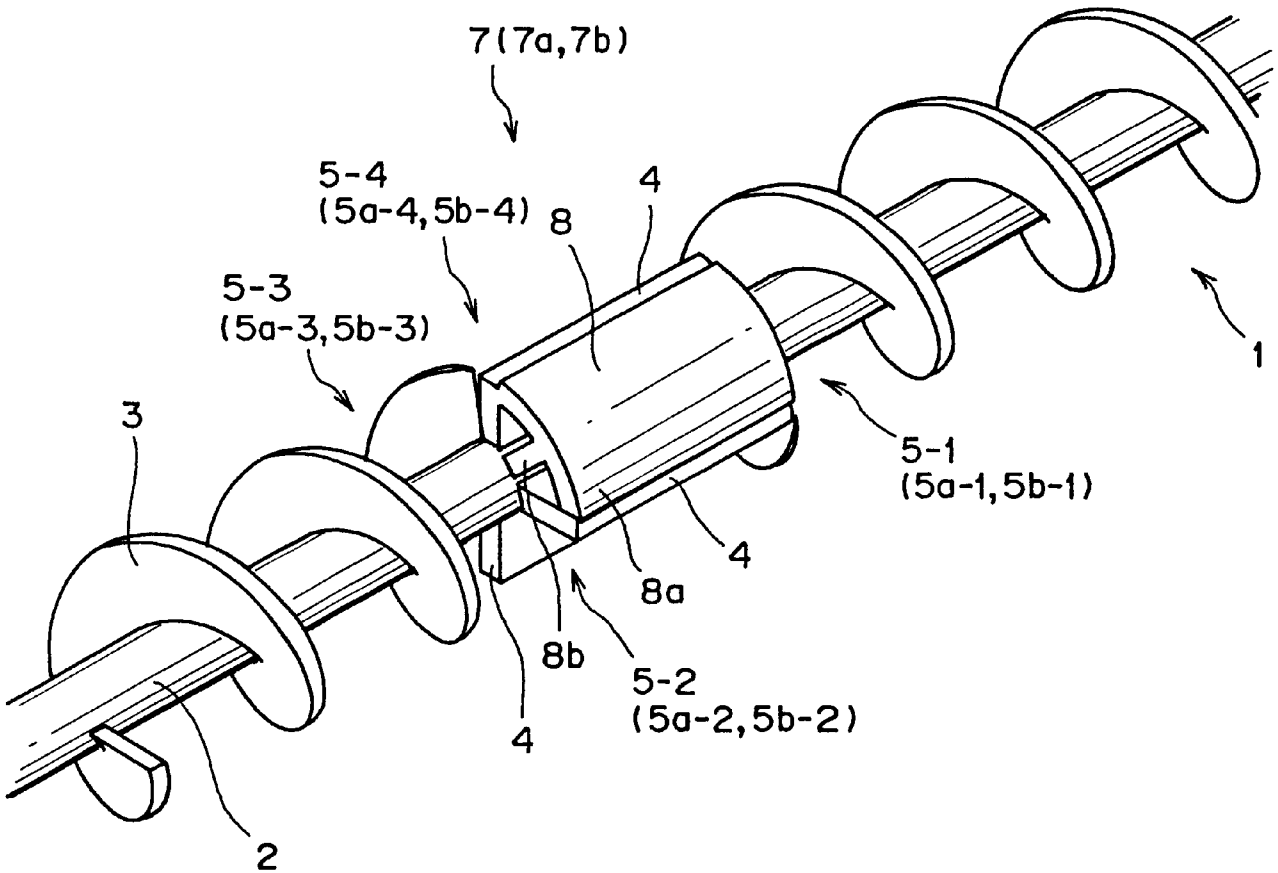
FIG. 4 is an enlarged, fragmentary perspective view similar to FIG. 3, but also showing a stop of the developing device of the first inventive concept.
Figure 5:
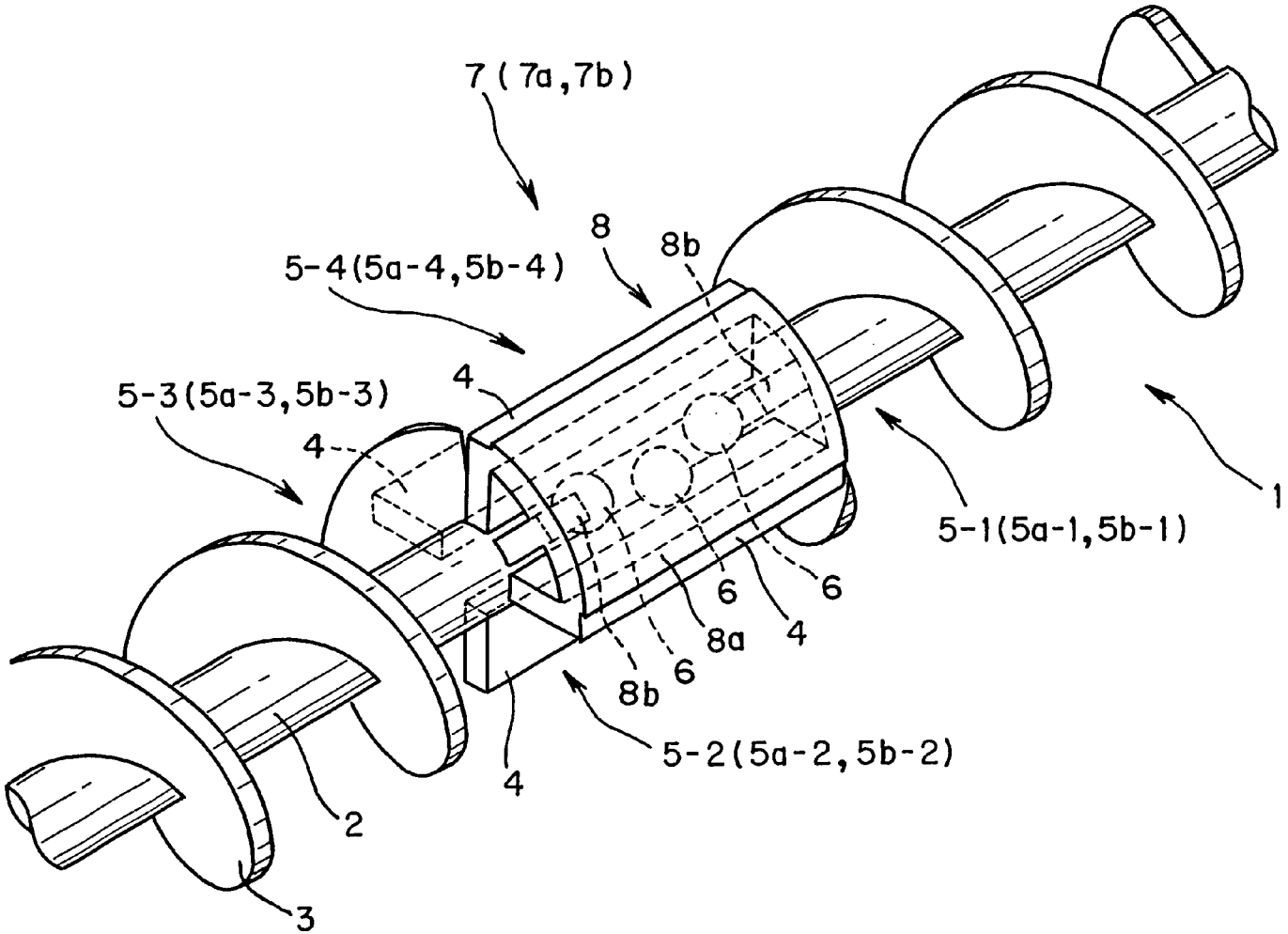
FIG. 5 is a view similar to FIG. 4, but showing auxiliary stirring members in phantom lines.

The developing device (developing unit) 100 will now be described in further detail using FIGS. 1 through 5:

FIG. 1 is a cross-sectional side view, taken along line A—A of FIG. 2, showing the structure of the developing device; FIG. 2 is a plan view of the developing device of FIG. 1; FIG. 3 is a fragmentary, enlarged perspective view of the stirring and conveying screw 1; FIG. 4 is a fragmentary, enlarged perspective view showing the stop 8; and FIG. 5 is a view similar to FIG. 4, but showing the auxiliary stirring members 6 (FIG. 3).

For clarity, in FIG. 2, illustration of the photosensitive drum 51 is omitted. Likewise, in FIGS. 1–3, illustration of the stop 8 is omitted. And in FIGS. 1 and 5, illustration of the auxiliary stirring member 6 is omitted.

The developing unit 100 in the image forming apparatus of the first embodiment develops a latent image, which is a pattern of electrical charges formed on the photosensitive drum 51, into a visible form using, for example, a two-component developer composed of a toner and a carrier (magnetic powder). The developing unit 100 includes, as shown in FIG. 1, a developing roller 32, a stirring and conveying screw (hereinafter also called the stirring and conveying member), another stirring and conveying screw 21, a housing 30, and a conveying puddle 31.

The developing roller 32 includes a multi-pole fixed magnet in the form of an axle, and a rotary sleeve, in the form of a hollow tube of non-magnetic material such as aluminum alloy, rotatably mounted around the fixed magnet. With the fixed magnet kept immovable, the rotary sleeve is driven by a non-illustrated drive mechanism for rotation (in the direction of arrow b in FIG. 1) cooperative with the rotation (in the direction of arrow a in FIG. 1) of the photosensitive drum 51.

Thus, the developing roller 32 attracts the developer to its outer surface of the rotary sleeve by the magnetic force of the individual magnet poles and conveys the developer into a developing region between the photosensitive drum 51 and the developing roller 32, with the developer held on the outer sleeve surface, to develop the latent image on the photosensitive drum 51 into an image of toner and thus a visible image.

Also, the developing roller 32 is disposed adjacent to and parallel to the photosensitive drum 51. The conveying puddle 31 is disposed upstream of the developing region, which is defined between the developing roller 32 and the photosensitive drum 51, facing the circumferential surface of the developing roller 32 on the opposite side of the photosensitive drum 51 with respect to the developing roller 32 so that the developing roller 32 receives from the conveying puddle 31 the developer having been stirred and mixed by the stirring and conveying screws 1, 21.

The conveying puddle 31 includes a rotary shaft parallel to the developing roller 32, and a plurality of (four in FIG. 1) plates radially projecting from the rotary shaft and each having a width equal to the entire shaft length. The conveying puddle 32 is driven by a nonillustrated drive mechanism for rotation in the same direction as that of the developing roller 32 (in the direction of arrow c in FIG. 1) to convey the developer in to the developing roller 32.

The second-named stirring and conveying screw 21, as shown in FIGS. 1 and 2, is disposed adjacent to the conveying puddle 31, and includes a shaft parallel to the conveying puddle 31 and the developing roller 32 and a continuous spiral blade 3 extending on and around the shaft. Further, the stirring and conveying screw 21 is driven by a non-illustrated drive mechanism for rotation in the same direction as the rotating direction of the developing roller 32 (in the direction of arrow d in FIG. 1) to convey the developer in a direction (from left to right in FIG. 2) corresponding to the rotating direction while stiring.

The first-named stirring and conveying screw 1 includes, as shown FIGS. 2 and 3, a shaft 2 and a continuous spiral blade 3 extending on and around a circumferential surface of the shaft 2. The stirring and conveying screw 1 is disposed adjacent to and parallel to the stirring and conveying screw 21, and has two toner gathering ports 7 around the shaft 2 by partially cutting out the continuous spiral blade 3. The two gathering ports 7 are spaced from each other along the toner delivery path.

In the following description, the upstream and downstream gathering ports are individually designated by 7*a*, 7*b*, respectively. And these two gathering ports are collectively designated by 7.

Each toner gathering port 7 is divided into a plurality of segmental stirring chambers 5-1 through 5-4 by a plurality of (four in FIG. 3) radial plates 4 projecting from the circumferential surface of the shaft 2 of the stirring and conveying member 1. At least one (three in FIG. 3) spherical auxiliary stirring member 6 is movably held in at least one of the segmental stirring chambers 5-1. And a stop 8, as shown in FIGS. 4 and 5, is disposed at the toner gathering port 5-1 and surrounds the radial puddles 4 to cooperate with the radial puddles 4 in preventing the spherical auxiliary stirring members 6 from moving off the toner gathering port and for allowing the toner to pass through the toner gathering port 7.

These auxiliary stirring members 6, like the housing 30, the stirring and conveying screws 1, 21, are made of electrically conductive material, specifically non-magnetic metal, such as aluminum, brass or SUS 303, or electrically conductive resin.

In the following description, the individual segmental stirring chambers associated with the upstream toner gathering port 7*a* are designated by 5*a*-1 through 5*a*-4, respectively, and those associated with the downstream toner gathering port 7*b* are designated by 5*b*-1 through 5*b*-4, respectively. And the individual segmental stirring chambers in an arbitrary toner gathering port are designated by 5-1 through 5-4, respectively.

The stop 8 includes a circumferential covering 8*a* arcuately extending between a pair of adjacent radial plates 4, 4 defining the segmental stirring chamber 5-1, and a pair of radial columns 8b disposed one at each of front and rear ends of the segmental stirring chamber 5-1 and each extending between the circumferential covering 8*a* and the shaft 2. The stop 8 and the associated two radial plates 4, 4 surrounds the segmental stirring chamber 5-1 from all directions to movably keep the three auxiliary stirring members 6 within the segmental stirring chamber 5-1 in a way that during the stirring and conveying of developer (toner), the auxiliary stirring members 6 are prevented from removing off the toner gathering port 7 and, in the meantime, the developer (toner) is allowed to pass through the segmental stirring chamber 5-1.

The stop 8, like the stirring and conveying screw 1, is made of electrically conductive material.

In the first-named stirring and conveying screw 1, the upstream segmental stirring chamber 5*a*-1 holding the auxiliary stirring members 6 in the upstream toner gathering port 7*a* is located relative to the downstream segmental stirring chamber 5*b*-1 holding the auxiliary stirring members 6 in the downstream toner gathering port 7*b* in such a manner that the toner having passed the segmental stirring chambers 5*a*-1 through 5*a*-4 other than the segmental stirring chamber 5*a*- 1, which holds the auxiliary stirring members 6 in the upstream toner gathering port 7*a*, is allowed to pass through the segmental stirring chamber 5*b*-1, which holds in the downstream toner gathering port 7*b*.

Specifically, in the first embodiment, as shown in FIG. 2, the four radial plates 4 associated with the upstream toner gathering 7*a* is identical in phase with those associated with the downstream toner gathering port 7*b* longitudinally of stirring and conveying screw 1. And the upstream segmental stirring chamber 5*a*-1 associated with both the stop 8 and the auxiliary stirring members 6 at the upstr5eam toner gathering port 7*a* is different in phase by approximately 90 degrees about the shaft 2 from the downstream segmental stirring chamber 5*b*-1 associated with both the stop 8 and the auxiliary stirring members 6 at the downstream toner gathering port 7*b*.

The relationship between the segmental stirring chamber 5*a*-1 associated with the upstream toner gathering port 7*a* and the segmental stirring chamber 5*b*- 1 associated with the downstream toner gathering port 7*b* is obtained, based on the results of preliminary measurement of charge amounts on the developer (toner) under various conditions, in a way that optimum charging can be achieved.

The stirring and conveying screw 1 extends parallel to the developing roller 32 and the stirring and conveying screw 21, and the shaft 2 of the stirring and conveying screw 1 is driven by a non-illustrated drive motor (drive source) for rotation (in the direction of arrow e in FIG. 1) to convey the developer (toner) in the direction of rotation (from right to left in FIG. 1) along the developer (toner) delivery path leading from a non-illustrated toner source to the photosensitive drum 51.

Further, the developing roller 32, the stirring and conveying screws 1, 21 and the stirring puddle 31 are all enclosed by the housing 30 of electrically conductive material.

Furthermore, the housing 30, the stirring and conveying screws 1, 21, the stop 8 and the auxiliary stirring members 6 are made of non-magnetic material so that carrier in magnetic powder is not allowed to adhere to them.

During the developing, a bias voltage is applied to the stirring and conveying screws 1, 21 and the housing 30 by a non-illustrated power source, to give them a potential of a polarity opposite to the circumferential surface of the photosensitive drum 51.

With the image forming apparatus thus constructed as the first embodiment, by the action of the continuous spiral blade 3 of the stirring and conveying screw 1, toner delivered from a non-illustrated toner hopper is stirred and mixed with carrier while being conveyed, and the resulting mixture is conveyed as a developer. The stirring and conveying screw 1 serves to crush the cohered toner into small particles.

During the stirring and conveying, the developer (toner) is electrically charged as it comes into contact with the stirring and conveying screw 1 and the housing 30 to which a bias voltage is applied.

As one of the most significant features, the developer (toner) to be conveyed by the stirring and conveying screw 1 temporarily stays at the toner gathering port, during which it is further stirred and mixed by the radial plates 4 and the housing 30 in the segmental stirring chamber 5. As a result, the cohered toner is crushed into small particles and, at the same time, the resulting toner is electrically charged more.

Specifically, at the toner gathering port 7, also the auxiliary stirring members 6 associated with both in the segmental stirring chamber 5-1 and the stop 8 are electrically charged as they come into contact with the radial plates 4 and the stop 8. While passing through the segmental stirring chamber 5-1 holding these auxiliary stirring members 6, the developer (toner) is stirred in repetitious contacts with the auxiliary stirring members 6 and the stop 8 in the associated segmental stirring chamber 5-1 not only to diffuse the cohered toner but also to facilitate electrically charging.

Additionally, the developer (toner) having passed through the segmental stirring chambers **5*a*-2 through 5*a*-4 other than the segmental stirring chamber 5*a*-1, in which the auxiliary stirring members 6 are held, at the upstream toner gathering port 7*a* subsequently passes through the segmental stirring chamber 5*b*-1, in which the auxiliary stirring members 6 are held, at the downstream toner gathering port 7*b* to have additional electric charges via the auxiliary stirring members 6 at the downstream segmental stirring chamber 5*b*-1**.

The developer (toner) having stirred and conveyed by the first-named stirring and conveying screw 1 is further stirred and conveyed then by the second-named stirring and conveying screw 21, whereupon the resulting developer (toner) is delivered to the developing roller 32 by the conveying puddle 31.

Then the developer (toner) received by the developing roller 32 is held in a constant thickness of layer on the circumferential roller surface with rotation of the developing roller 32. After that, only toner of the developer adheres to a latent image of elestrostatic charges, which is formed on the photosensitive drum 51, to develop the latent image into a pattern of toner and hence a visible image.

According to the image forming apparatus of the first embodiment, since the developer (toner) is stirred and mixed by the stirring puddle 4 and the housing 30 in the toner gathering port 7, it is possible to fully mix the developer and crush the cohered toner into small particles as well as to charge the toner particles further by the stirring puddle 4.

In the segmental stirring chamber 5-1, in which the stop 8 and the auxiliary stirring members 6 are held, at the toner gathering port 7, since the developer (toner) comes into repetitious contact with the stirring puddle 4 and the stop 8, sufficient mixing of the developer (toner) and diffusion of the cohered toner as well as sufficient electric charging of the toner particles can be realized.

Further, since the stop 8 is located around the shaft 2 at the toner gathering port 7, it is possible to movably hold the auxiliary stirring members 6 within the toner gathering port 7 and to stir and electrically charge the toner more. And since the stirring and conveying screw 1 is simple in construction, it is possible to reduce the cost of manufacture.

Furthermore, partly since two or more stirring and conveying screws 1, 21 are arranged along the toner delivery path and partly since the toner gathering ports 7 are disposed each around the shaft 2 of the upstream stirring and conveying screw 1, it is possible to stir and electrically charge the toner fully and uniformly, thereby guaranteeing improved image quality.

In addition, since the auxiliary stirring members 6 are spherical, it is possible to stir and electrically charge the toner without unnecessarily preventing flow of the toner at the toner gathering port 7 and, even when the stirring and conveying screw 1 is in rotation, it is possible to reduce abrasions, vibrations and sounds, which might occur between the stirring and conveying screw 1, the stop 8 and the auxiliary stirring members 6.

Figure 7:
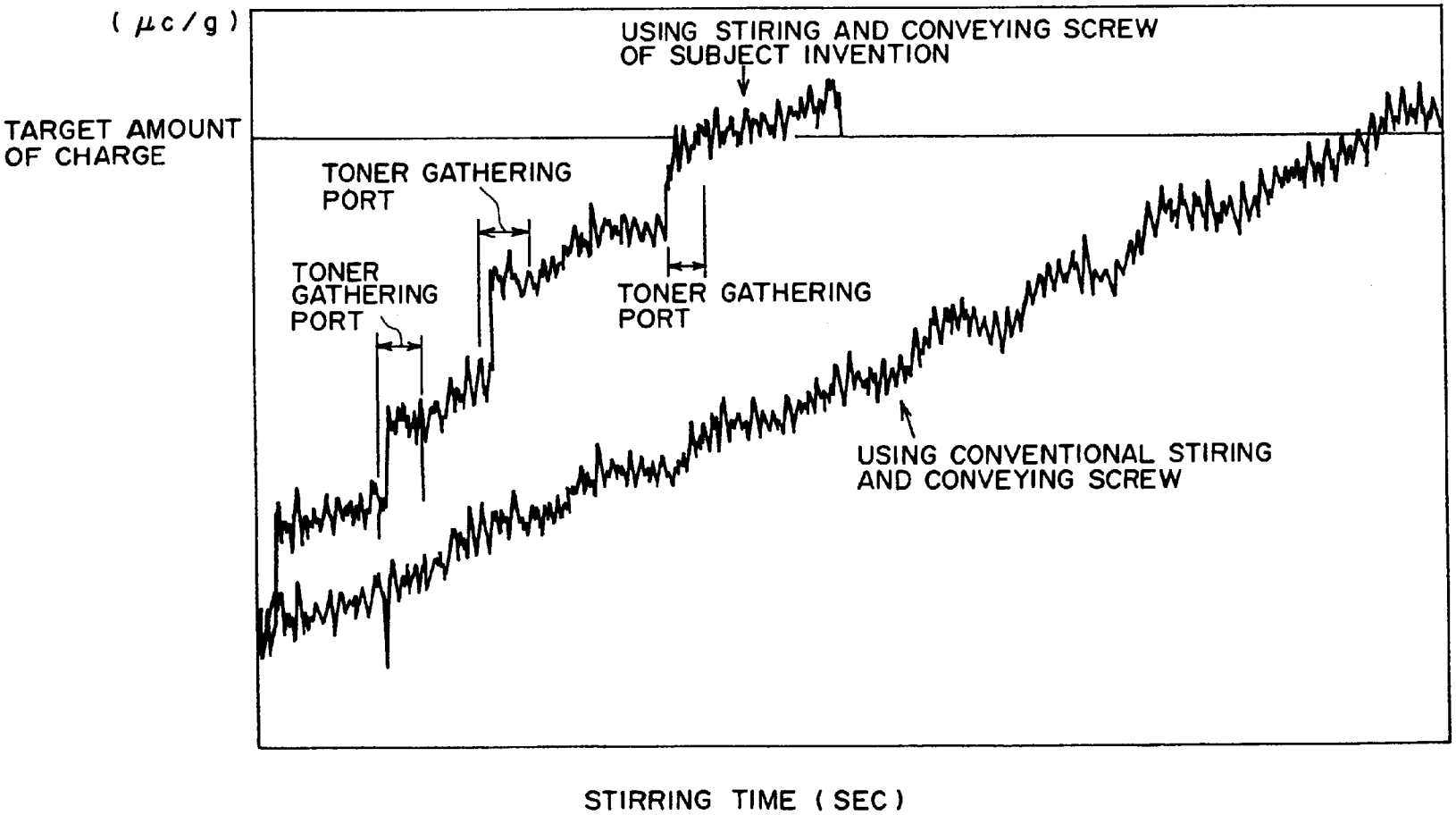
FIG. 7 is a graph showing a relationship between the stirring time and the amount of electrical charge when a developer is stirred and conveyed using a stirring and conveying screw of the image forming apparatus of the second inventive concept, also showing a comparative relationship that was obtained using a conventional stirring and conveying screw.

FIG. 7 is a graph showing a relationship between the stirring time and the amount of charge when developer was stirred and conveyed using a stirring and conveying screw that is identical in shape with the subject stirring and conveying screw 1, which is used in the image forming apparatus of the first embodiment, in comparison with a comparative relationship obtained when the same developer was stirred and conveyed using a conventional stirring and conveying screw.

In the comparison shown in FIG. 7, using the subject stirring and conveying screw having three toner gathering ports 7, the experiment was carried out in the same various conditions, such as rotational speed of the screw and bias voltage, as those for the experiment using the conventional stirring and conveying screw.

As shown in the graph of FIG. 7, when the developer (toner) was conveyed using the subject stirring and conveying screw, the amount of charges of the developer (toner) increased drastically while the developer (toner) was staying in the toner gathering port 7. This proves that with the subject stirring and conveying screw, the developer (toner) can be electrically charged to a target amount of charge in a reduced period of time as compared to the comparative example using the conventional stirring and conveying screw.

In the stirring and conveying screw 1, the four radial puddles 4 at the upper toner gathering port **7*a* are arranged in the same phase with those at the downstream toner gathering port 7*b*. And since the segmental stirring chamber 5*a*-1, which is associated with the stop 8 and holds the auxiliary stirring members 6, at the upstream toner gathering port 7*a* is spaced in phase by approximately 90 degrees from the segmental stirring chamber 5*b*-1, which is associated with the stop 8 and holds the auxiliary stirring members 6, at the downstream toner gathering port 7*b*, part of the toner passed through the auxiliary-stirring-member-free segmental stirring chambers 5*a*-2 through 5*a*-4 other than the auxiliary-stirring-member-holding segmental stirring chamber 5a-1 at the upstream toner gathering port 7a then will pass through the auxiliary-stirring-member-holding segmental stirring chamber 5b-1 at the downstream toner gathering port 7b. This is, part of the developer (toner) failed to pass through the auxiliary-stirring-member-holding segmental stirring chamber 5a-1 at the upstream toner gathering port 7a and failed to be electrically charged by the auxiliary stirring members 6 at the upstream gathering port 7a will be electrically charged by the auxiliary stirring members 6 at the downstream gathering port 7b**. As a result, whole part of the developer (toner) can be electrically charged uniformly with no blurring, thus guaranteeing improved image quality.

Therefore, according to the image forming apparatus of the first embodiment, it is possible to improve the developer (toner) stirring ability and the charging ability, which speeds up the developing and hence the printing, realizing a compact developing device and also improved image quality.

(B) First Modification of Developing Device of First Embodiment

Figure 8:
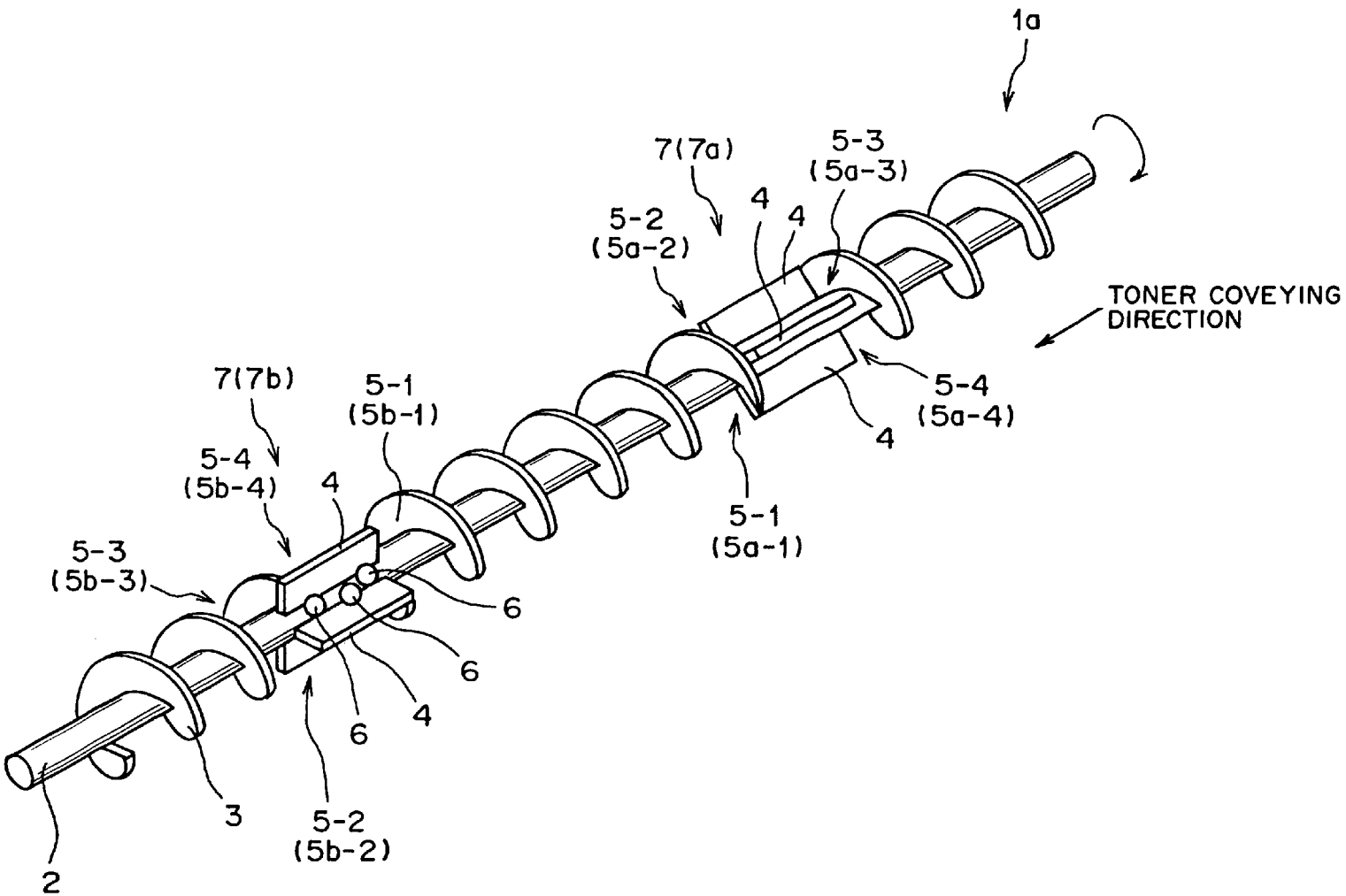
FIG. 8 is a perspective view showing a developing device according to a first modification, which is used in the image forming apparatus of the second inventive concept.

FIG. 8 is a perspective view of a developing device according to a first modification of the image forming apparatus of the first embodiment. Also in FIG. 8, illustration of the stop 8 is omitted for clarity, and like reference numbers designate similar parts or elements in connection with the first embodiment and the first modifications, so repetition of detailed description of the same parts or elements is omitted here.

A stirring and conveying screw 1a of the developing device according to the first modification, as shown in FIG. 8, includes a shaft 2 and a continuous spiral blade 3 extending on and around the shaft 2. The continuous spiral blade 3 is partly cut out at a pair of spaced portions to form two toner gathering ports 7 about a circumferential surface of the shaft 2.

In the following description, the upstream and downstream gathering port are individually designated by 7a, 7b, respectively. And these two gathering ports are collectively designated by 7.

In the stirring and conveying screw 1a of the first modification, like the first embodiment, each toner gathering port 7a, 7b is provided with four radial plates 4.

In the first modification, the auxiliary-stirring-member-holding segmental stirring chamber 5a-1 at the upstream toner gathering port 7a is located relative to the auxiliary-stirring-member-holding segmental stirring chamber 5b-1 at the downstream toner gathering port 7b in such a way that the toner passed through the auxiliary-stirring-member-free segmental stirring chambers 5a-2 through 5a-4 other than the auxiliary-stirring-member-holding segmental stirring chamber 5a-1 at the upstream toner gathering port 7a.

Specifically, in the stirring and conveying screw 1a, as shown in FIG. 8, four radial plates 4 at the upstream toner gathering port 7a are spaced in phase by approximately 45 degrees from four radial plates 4 at the downstream toner gathering port 7b. And the segmental stirring chamber 5a-1, which is associated with the stop 8 and holds the auxiliary stirring members 6, at the upstream toner gathering port 7a is spaced in phase by approximately 135 degrees from the segmental stirring chamber 5b-1, which is associated with the stop 8 and holds the auxiliary stirring member 6, at the downstream toner gathering port 7b.

The arrangement of the radial plates 4 at each toner gathering port 7a, 7b of the stirring and conveying screw la and the relative positional relationship between the segmental stirring chamber 5a-1 at the upstream toner gathering port 7a and the segmental stirring chamber 5b-1 at the downstream stirring chamber 5b- 1 is obtained, based on the results of preliminary measurement of charge amounts on the developer (toner) under various conditions, in a way that optimum charging can be achieved.

In the image forming apparatus (developing device) having the foregoing stirring and conveying screw 1a, like the image forming apparatus of the first embodiment, the toner delivered from a non-illustrated toner hopper is mixed with carrier while being stirred and conveyed by the stirring and conveying screw 1a. The stirring and conveying screw 1a continues conveying the resulting mixture as a developer.

During that time, the toner passed through the auxiliary-stirring-member-free segmental stirring chambers 5a-2 through 5a-4 other than the auxiliary-stirring-member-holding segmental stirring chamber 5a-1 at the upstream gathering port 7a will pass through the auxiliary-stirring-member-holding segmental stirring chamber 5b-1 at the downstream toner gathering port 7b.

The developer (toner) stirred and conveyed by this stiring and conveying screw 1a and electrically charged is then further stirred and conveyed by another stirring and conveying screw 21, whereupon the resulting developer (toner) is then conveyed to the developing roller 32 by the conveying puddle 31.

Thus in the image forming apparatus according to the first modification, like the first embodiment, the partial toner passed through the auxiliary-stirring-member-free segmental stirring chamber 5a-2 through 5a-4 other than the auxiliary-stirring-member-holding segmental stirring chamber 5a-1 at the upstream toner gathering port 7a will pass through the auxiliary-stirring-member-holding segmental stirring chamber 5a-1 at the downstream toner gathering port 7b. This is, the partial developer (toner) failed to pass through the auxiliary-stirring-member-holding segmental stirring chamber 5a-1 at the upstream toner gathering port and also failed to be electrically charged by the auxiliary stirring members 6 there will be electrically charged by the auxiliary stirring members 6 in the auxiliary-stirring-member-holding segmental stirring chamber 5b-1 at the downstream toner gathering port 7b. As a result, the whole developer (toner) can be electrically charged uniformly with no blurring, thus guaranteeing improved image quality.

(C) Second Modification of Developer Device of First Embodiment

Figure 9:
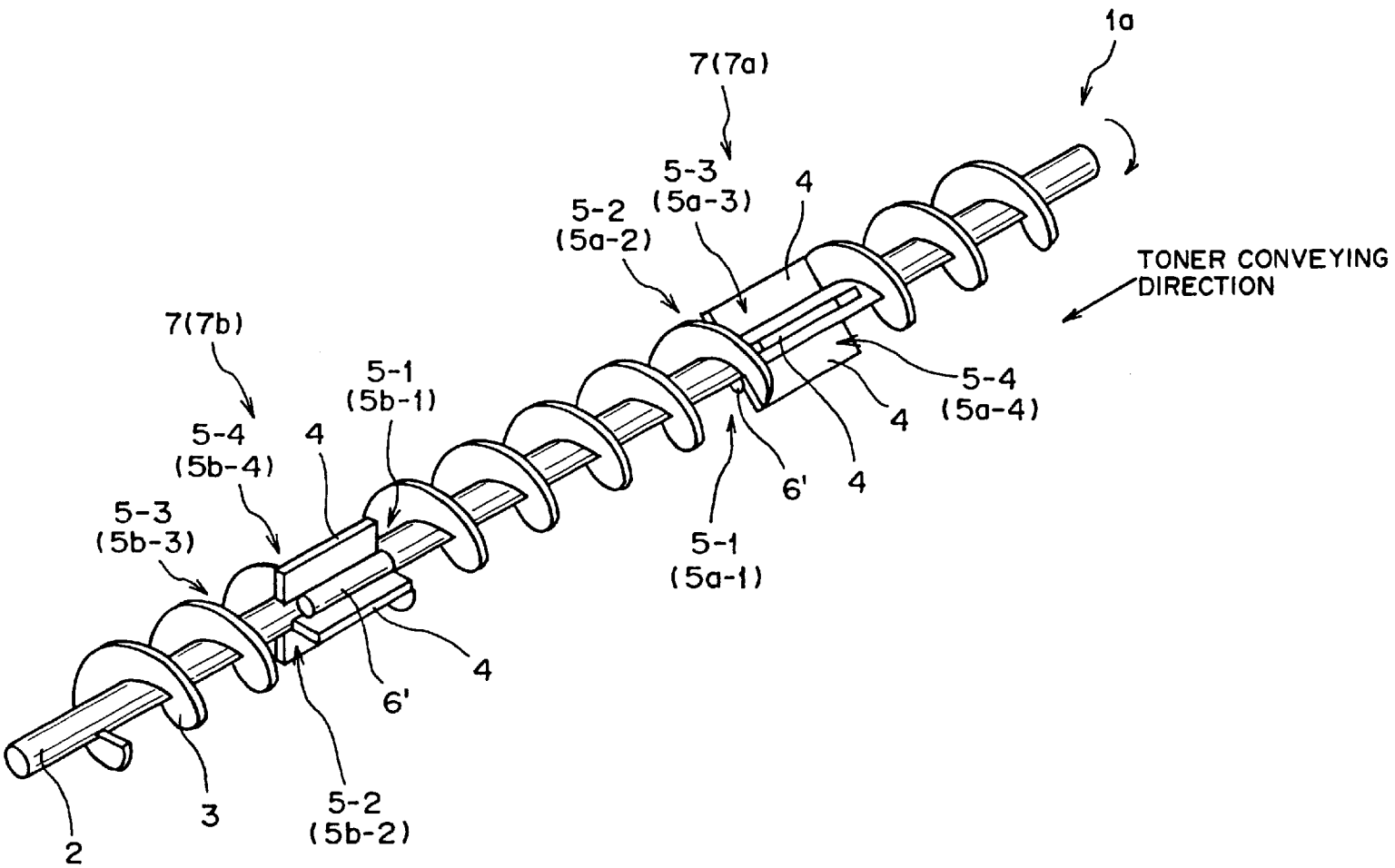
FIG. 9 is a perspective view similar to FIG. 8, but showing another developing device according to a second modification, which is used in the image forming apparatus of the second inventive concept.

FIG. 9 is a perspective view showing a developing device according to a second modification of the image forming apparatus of the first embodiment. In the developing device of the second embodiment, as shown in FIG. 9, the spherical auxiliary stirring members 6 of the first modification is substituted by a single cylindrical auxiliary stirring member 6'.

Also in FIG. 9, illustration of the stop 8 is omitted, and like reference numbers designate similar parts or elements in connection with the first embodiment, the first modification and this second modification, so repetition of detailed description of the same parts or elements is omitted here.

According to the image forming apparatus equipped with the developing device of the second modification, it is possible to achieve the same results with the image forming apparatus of the first modification.

(D) Third Modification of Developing Device of First Embodiment

Figure 10:
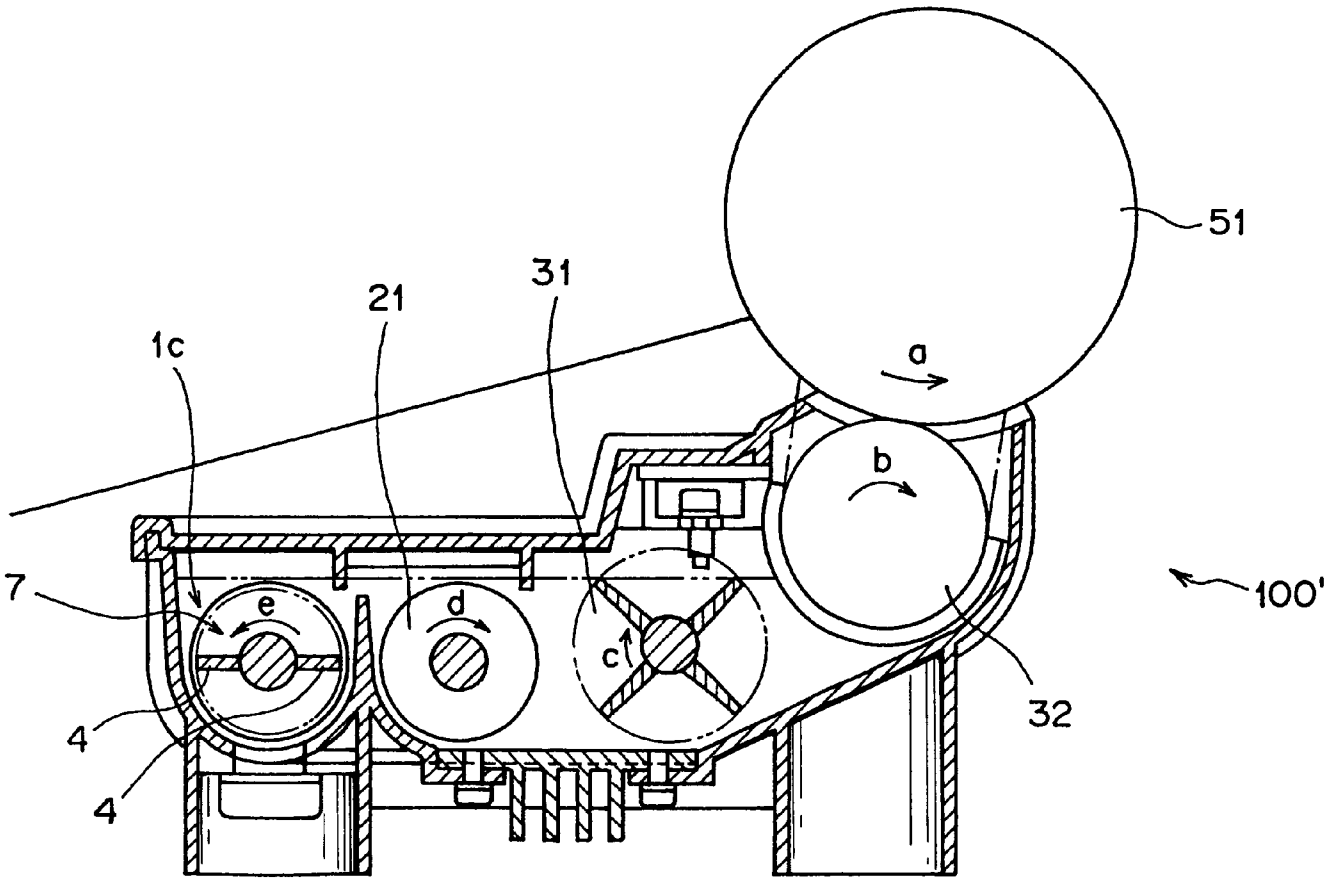
FIG. 10 is a partially cross-sectional, side view of still another developing device according to a third modification, which is used in the image forming apparatus of the second inventive concept.

FIG. 10 is a partially cross-sectional side view showing a developing device according to a third modification of the image forming apparatus of the first embodiment. In the stirring and conveying screw 1*c* in the developing device 100' of the third modification, as shown in FIG. 10, each toner gathering port 7 is divided into two segmental (semi-cylindrical) stirring chambers 5 by two radial plates 4 projecting in opposite directions from the shaft 2 of the stirring and conveying screw 1.

Also in FIG. 10, illustration of the stop 8 is omitted for clarity, and like reference numbers designate similar parts or elements in connection with the first embodiment, the first and second modifications and this third modification, so repetition of detailed description of the same parts or elements is omitted here.

At least one of the segmental stirring chambers, like the first embodiment, is equipped with the stop 8. In the segmental stirring chamber equipped with the stop 8, at least one auxiliary stirring member 6 similar to that of the first embodiment and an auxiliary stirring member 6' similar to that of the second modification are movably accommodated (not shown).

Figure 11:
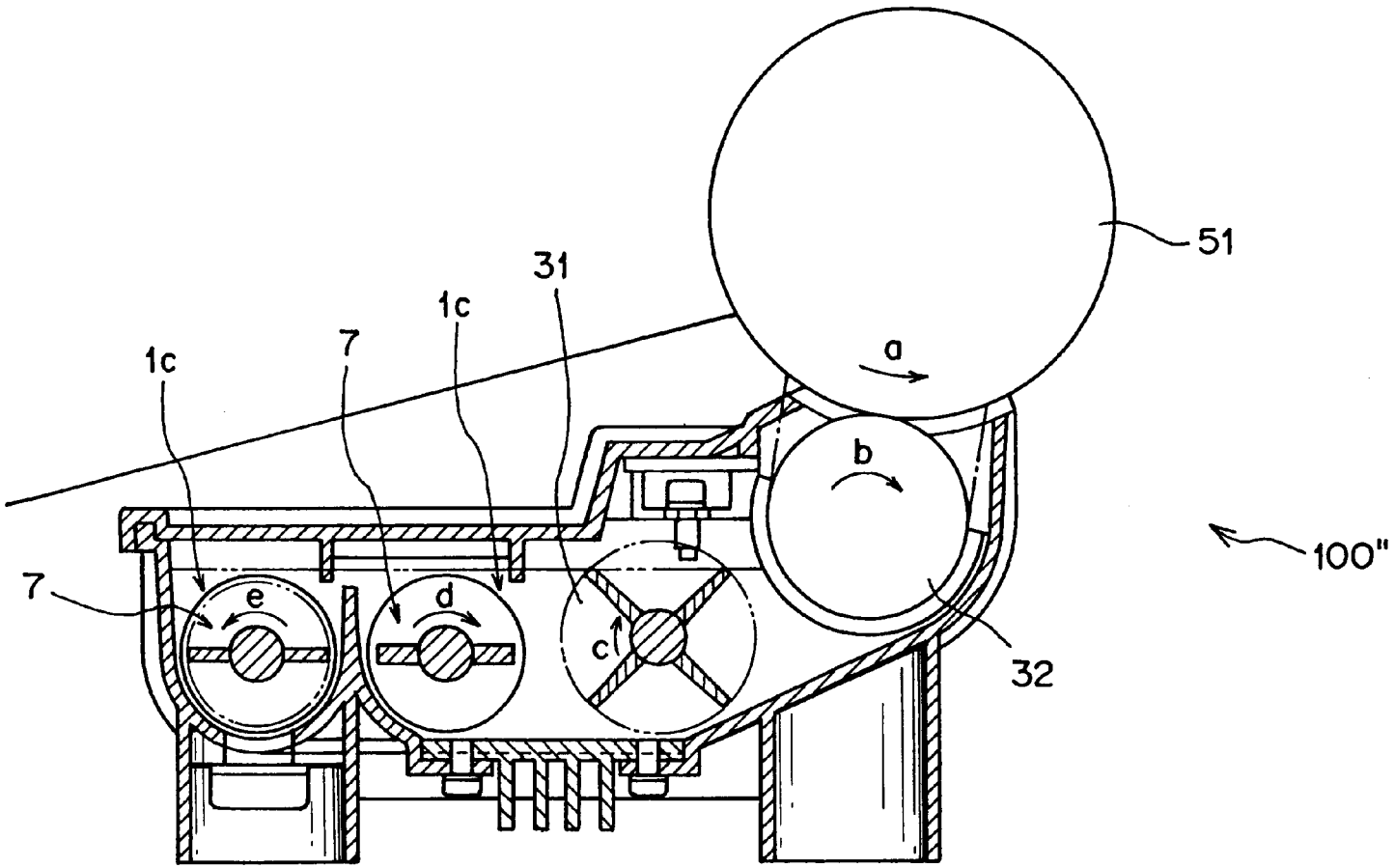
FIG. 11 is a partially cross-sectional, side view similar to FIG. 10, but showing a further developing device according to a fourth modification, which is to be used in the image forming apparatus of the second inventive concept.

According to the image forming apparatus (developing device 100') having the stirring and conveying screw 1*c*, it is possible to achieve the same results as the first and second modifications. In addition, since the stirring and conveying screw 1*c* is simple in construction, it is possible to reduce the cost of manufacture. (E) Fourth Modification of Developing Device of First Embodiment:

FIG. 11 is a partially cross-sectional side view showing a developing device according to a fourth modification of the image forming apparatus of the first embodiment. In the developing device 100" of the fourth modification, as shown in FIG. 11, the stirring and conveying screw 21 of the developing device 100' of the third modification is substituted by a stirring and conveying screw (stirring and conveying member) 1*c*.

Also in FIG. 11, illustration of the stop 8 is omitted for clarity, and like reference numbers designate similar parts or elements in connection with the first embodiment, the foregoing modifications and this fourth modification, so repetition of detailed description of the same parts or elements is omitted here.

According to the image forming apparatus equipped with the developing device 100", it is possible to achieve the same results as the third modification. In addition, partly since two stirring and conveying screws 1c along the toner delivery path, and partly since the downstream stirring and conveying screw 1*c* also is equipped with the toner gathering port 7, it is possible to realize sure stirring and uniform electrical charging of developer (toner), improving the stirring ability and the electrical charging ability. As a result, it is possible to speed up the the developing process and to reduce in size the developing device as compared to the conventional developing device as well as to improve the image quality.

(F) Second Embodiment

Figure 12:
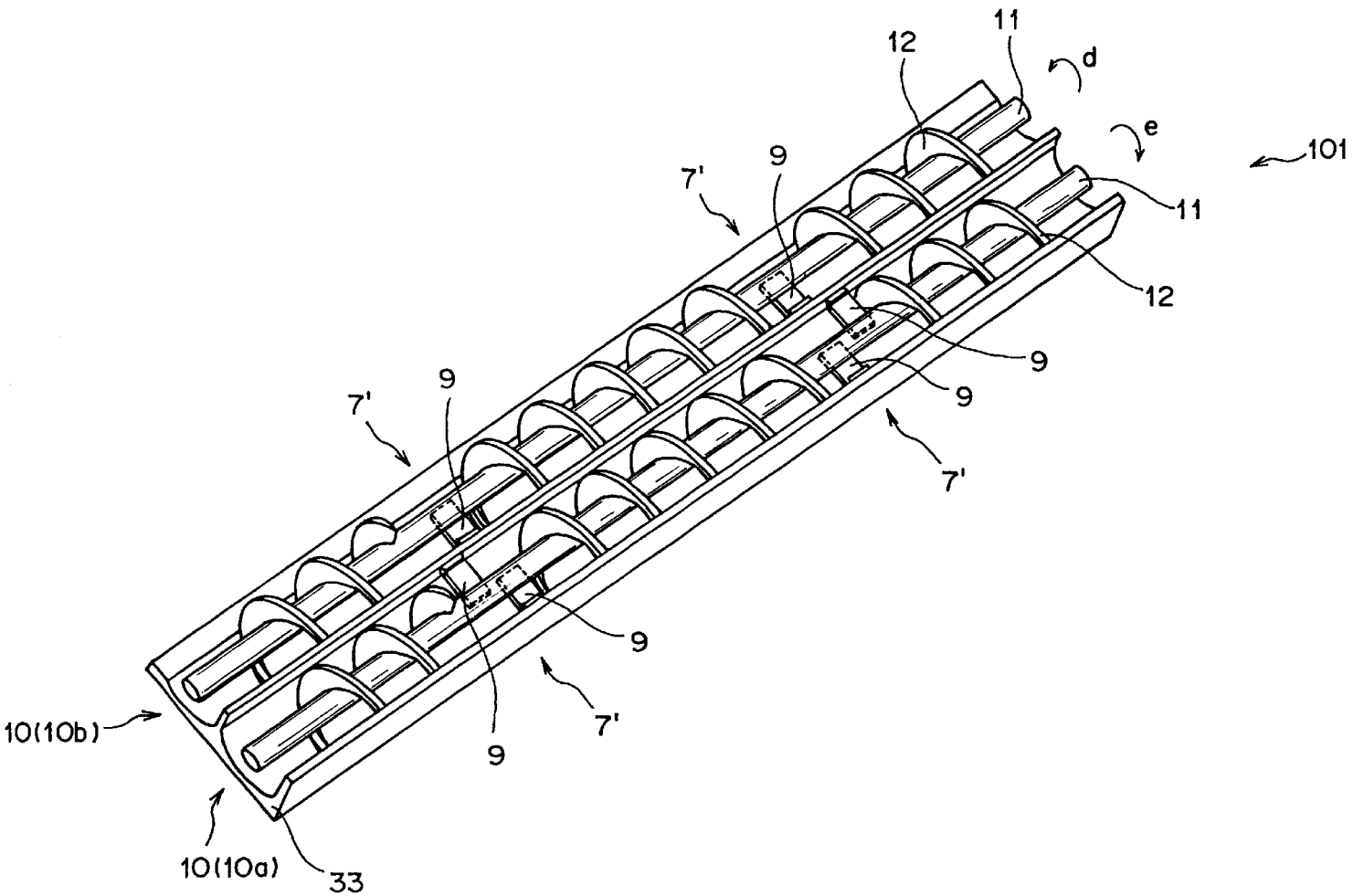
FIG. 12 is a perspective view showing main part of a developing device of an image forming apparatus according to an additional concept of the present invention.
Figure 13:
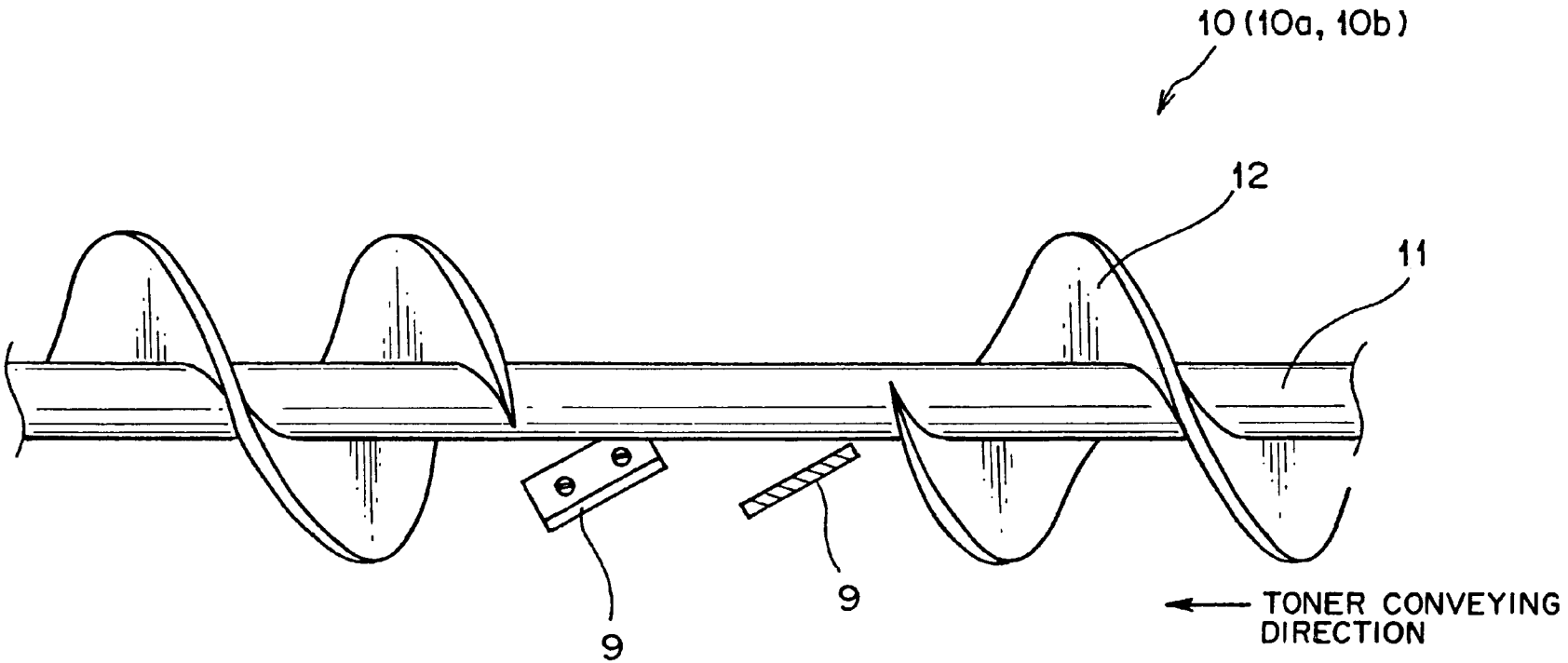
FIG. 13 is an enlarged side view, with parts broken away, of a stirring and conveying screw, which is used in the developing device of the last-named inventive concept.
Figure 14:
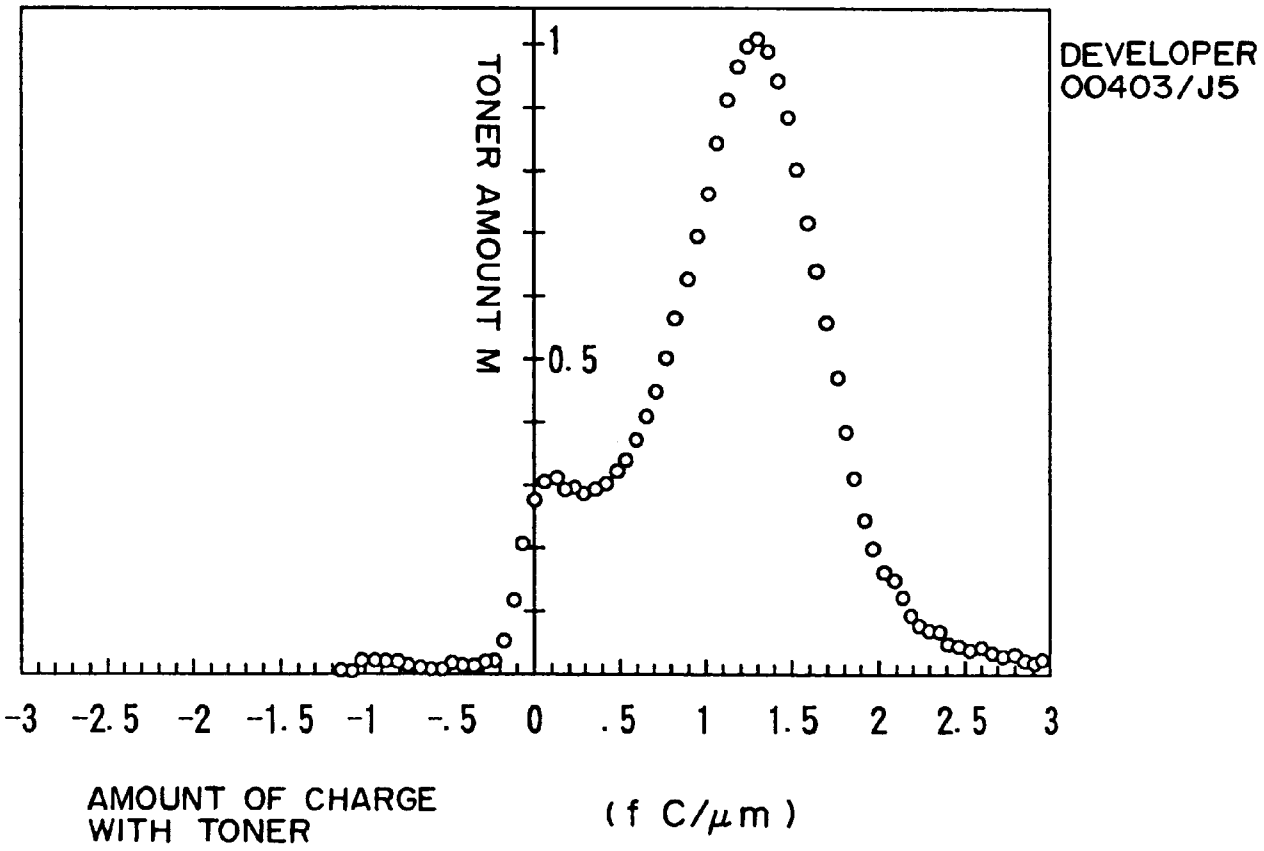
FIG. 14 is a graph showing an example of distribution of charge quantities of a developer in a typical printing machine.

In an image forming apparatus according to a second embodiment of the present invention, the developing device 100 of the image forming apparatus of the first embodiment is substituted by a developing device 101 shown in FIGS. 12 and 13.

FIG. 12 is a perspective view showing main parts of the developing device 101 of the image forming apparatus of the second embodiment, and FIG. 13 is an enlarged side view, partially in cross section, of a stirring and conveying screw 10 of the second embodiment. In FIG. 12, illustration of the developing roller and the photosensitive drum is omitted for clarity.

The developing device 101 supplies toner to the photosensitive drum (image supporting body) to develop a latent image, which is formed on the photosensitive drum, into a visible image, and includes, as shown in FIG. 12, stirring and conveying screws (stirring and conveying members) 10, toner gathering ports 7', a casing 33, and an additional stirring member 9.

The stirring and conveying screws 10 stir a developer (toner) from a non-illustrated toner source to the photosensitive drum along a toner delivery path and stir during the conveying, extending parallel to the photosensitive drum and the developing roller likewise the stirring and conveying screw 1 of the first embodiment shown in FIG. 1.

The developing device 101 of the second embodiment is equipped with two stirring and conveying screws 10 extending parallel to each other.

In the following description, the upstream and downstream stirring and conveying screws are individually designated by 10*a*, 10*b*, respectively. And an arbitrary stirring and conveying screw is designated by 10.

In the second embodiment, each stirring and conveying screw 10 includes, as shown in FIG. 12, a shaft 11, and a continuous spiral blade 12 extending on and around the shaft 11 and partially cut out at two portions to define two toner gathering ports 7' around the shaft 11.

Each stirring and conveying screw 10 and the toner gathering ports 7' are enclosed by the casing 33.

In each toner gathering port 7', as shown in FIGS. 12 and 13, at least one (two in FIGS. 12 and 13) stirring and charging member 9, in the form of a plate, projecting from the casing 33 into the toner gathering port 7'.

The stirring and charging member 9, as shown in FIG. 13, has a surface extending at a predetermined angle with respect to the toner flowing direction in the toner gathering port 7'. Preferably each stirring and charging member 9 is disposed under the shaft 11 so as to be embedded in the gathered and staying developer (toner).

The stirring and conveying screws 10, the casing 33 and the stirring and charging member 9 are made of electrically conductive material, specifically non-magnetic metal, such as aluminum, brass or SUS 303, or electrically conductive resin.

Further, in the developing device 101 of the second embodiment, a bias voltage of opposite polarity is applied to the circumferential surface of the photosensitive drum by a non-illustrated power source so that the stirring and conveying screws 10, the casings 33 and the stirring and charging members 9 are electrically charged.

Furthermore, the shaft 11 is operatively connected to a non-illustrated source for rotation such that the developer (toner) is conveyed in a predetermined direction (from right to left in the upstream stirring and conveying screw 10*a* or from left to right in the downstream stirring and conveying screw 10*b* in FIG. 13) by the thrusting force of the continuous spiral blade 12. In this toner delivery path, the toner gather port 7' serves to temporarily halt the toner being conveyed.

With the thus constructed developing device 101 of the image forming apparatus of the second embodiment, the toner delivered from a non-illustrated toner hopper is mixed with carrier during the stirring and conveying by a continuous spiral blade 12 of the upstream stirring and conveying screw 10*a*, the resulting mixture being conveyed as a developer. This stirring and conveying action of the continuous spiral blade 12 crushes the cohered toner into small particles.

During this stirring and conveying process, the developer (toner) is electrically charged via the upstream stirring and conveying screw 10*a* and the casing 33, to which a bias voltage is applied, as the developer (toner) comes into contact with the upstream stirring and conveying screw 10*a* and the casing 33.

And the developer (toner) being conveyed by the upstream stirring and conveying screw 10*a* temporarily stays at each toner gathering port 7' where the developer (toner) comes into contact with the stirring and charging member 9 and the casing 33 so that the cohered toner is crushed and the resulting small toner particles are charged with more electric charges.

Then the developer (toner) conveyed by the upstream stirring and conveying screw 10*a* is stirred and conveyed further in the same manner by the downstream stirring and conveying screw 10*b*. Also during the conveying by the downstream stirring and conveying screw 10*b*, at each toner gathering port 7', the cohered toner is crushed and the resulting small toner particles are charged with more electric charges.

Subsequently, the resulting developer (toner) is conveyed, by the conveying puddle, to the developer roller where the developer (toner) is held in a constant thickness of layer on the circumferential surface of the developing roller with rotation of the developing roller. After that, only the toner of the developer adheres to a latent image on the photosensitive drum to develop the latent image into a pattern of toner as a visible image.

According to the image forming apparatus (developing device 101) of the second embodiment, it is possible to achieve the same results as the first embodiment. And since the stirring and conveying screw 10 is simple in construction, it is possible to reduce the cost of manufacture. In addition, since the stirring and charging member 9 is in the form of at least one plate that is attached to (projects from) the casing 33 in a way that the plate surface extends at a predetermined angle with respect to the toner flowing direction in the toner gathering port, it is possible to stir and charge the toner with improved efficiency.

(G) Other Modifications:

The present invention should by no means be limited to the foregoing illustrated examples and various other changes or modifications may be suggested without departing from the gist of the inventive concept.

For example, in the stirring and conveying screw 1, 1*a*, 1*c*, 10 for each of the foregoing embodiments and modifications, the continuous spiral blade 3, 12 is cut out at a pair of local portions to form two toner gathering ports 7, 7'. Alternatively two or more continuous spiral blades extending on and around the shaft 2, 11 are spaced by a predetermined distance from one another along the shaft 2, 11, thereby defining between every pair of adjacent continuous spiral blades a toner gathering port about the circumferential surface of the shaft 2, 11.

Further, in each of the foregoing illustrated embodiments and modifications, developing was carried out using a two-component developer composed of toner and carrier. Alternatively a single-component developer including only toner, i.e. devoid of carrier, may be used in developing.

Furthermore, in the foregoing illustrated embodiments and modifications, the stirring and conveying screw 1, 1*a*, 1*c*, 10 is provided with two toner gathering ports 7, 7'. For alternatives, the number of the toner gathering ports 7, 7' may be one, three or more.

In addition, in the first embodiment, three auxiliary stirring members 6 are held in the segmental stirring chamber 5-1. For alternatives, the number of the auxiliary stirring members 6 may be one, two, four or more.

Likewise, in the second modification of the first embodiment, only one auxiliary stirring member 6' is held in the segmental stirring chamber 5-1. Alternatively two or more auxiliary stirring member 6' may be held in the segmental stirring chamber 5-1.

Also in the second modification of the first embodiment, for the stirring and conveying screw 1*a*, four radial plates 4 at the upstream toner gathering port 7*a* are spaced in phase by approximately 45 degrees from four radial plates 4 at the downstream toner gathering port 7*b*. Alternatively other angular or phase differences may be selected, depending on various conditions such as pitch and size of the continuous spiral blade 3, speed of rotation of the shaft 2, and amount of delivered developer (toner), in a way that distribution of charging on developer (toner) is optimum.

Further, in the first and second modification of the first embodiment, the segmental stirring chamber 5*a*-1, which is associated with the stop 8 and holds the auxiliary stirring member 6 (6'), at the upstream toner gathering port 7*a* is spaced in phase by approximately 135 degrees from the segmental stirring chamber 5*b*-1, which is associated with the stop 8 and holds the auxiliary stirring member 6 (6'), at the downstream toner gathering port 7*b*. In alternatives, other angular or phase differences may be selected, depending on various conditions such as pitch and size of the continuous spiral blade 3, speed of rotation of the shaft 2, and amount of delivered developer (toner), in a way that distribution of charging on developer (toner) is optimum.

Furthermore, in the first and the second modifications of the first embodiment, the relative positional relationship between the auxiliary-stirring-member-holding segmental stirring chamber 5*a*-1 at the upstream toner gathering port 7*a* and the auxiliary-stirring-member-holding segmental stirring chamber 5*b*-1 at the downstream stirring chamber 5*b*-1 is such that the developer (toner) passed through the auxiliary-stirring-member-free segmental stirring chambers 5*a* through 5*a*-4 (other than the segmental stirring chamber 5*a*-1) at the upstream toner gathering port 7*a* will pass through the auxiliary-stirring-member-holding segmental stirring chamber 5*b*-1 at the downstream toner gathering port 7*b*. Alternatively, at each toner gathering port 7*a*, 7*b*, the auxiliary stirring member 6 (6') may be held in a specified segmental stirring chamber that allows the largest amount of developer (toner) during developing.

In addition, in the fourth modification of the first embodiment, two stirring and conveying screws 1*c* extending parallel to each other are employed to stir and convey the developer (toner). Alternatively two arbitrary stirring and conveying screws selected from the stirring and conveying screws 1, 1*a*, 10 may extend parallel to each other. In another alternative, the stirring and conveying screw 1*c* may be employed for only the upstream stirring and conveying screw, and the stirring and conveying screw 21 devoid of the toner gathering port 7 may be employed for the downstream stirring and conveying screw.

Moreover, in the second embodiment, two stirring and conveying screws 10 (10*a*, 10*b*) extend parallel to each other to stir and convey the developer (toner). Alternatively the stirring and conveying screw 10*a* may be employed for only the upstream stirring and conveying screw, and the stirring and conveying screw 21 devoid of the toner gathering port 7' may be employed for the downstream stirring and conveying screw, or the abovementioned stirring and conveying screw 1, 1*a*, 1*c* may be employed for the downstream stirring and conveying screw.

What is claimed is:

1. A developing device for developing a latent image, which is formed on an image supporting body, into a visible image, said device comprising:

a toner source;

at least one stirring and conveying member of an electrically conductive material, extending between said toner source and the image supporting body, for conveying a toner from said toner source to the image supporting body longitudinally along a toner delivery path and stirring the toner being conveyed, said stirring and conveying member being electrically charged by a bias voltage to be applied during the developing and hence also serving to charge the toner with electricity during the stirring;

at least one toner gathering port, disposed in said toner delivery path, for temporarily halting the toner there during the conveying;

at least one auxiliary stirring member of an electrically conductive material, movable in said toner gathering port, for further stirring the toner staying in said gathering port, said auxiliary stirring member being electrically charged by said bias voltage and hence also serving to further charge the toner with electricity during the further stirring; and a stop, disposed at said toner gathering port, for preventing said auxiliary stirring member from moving off said toner gathering port and for allowing the toner to pass through said toner gathering port.

2. A developing device according to claim 1, wherein said stirring and conveying member includes a shaft extending along said toner delivery path and operatively connected to a drive source for rotation, and a continuous spiral blade extending on and around a circumferential surface of said shaft, said spiral blade having a cut-out portion defining said toner gathering port around the circumferential surface of said shaft.

3. A developing device according to claim 1, wherein said stirring and conveying member includes a shaft extending along said toner delivery path and operatively connected to a drive source for rotation, and at least two continuous spiral blades extending on and around a circumferential surface of said shaft, each of said spiral blades being spaced a predetermined distance from an adjacent one of said spiral blades axially of said shaft to define said toner gathering port around the circumferential surface of said shaft.

4. A developing device according to claim 2, wherein said stop surrounds said toner gathering port around the circumferential surface of said shaft.

5. A developing device according to claim 3, wherein said stop surrounds said toner gathering port around the circumferential surface of said shaft.

6. A developing device according to claim 2, wherein said toner gathering port is divided into a plurality of segmental stirring chambers by a plurality of radial plates projecting from the circumferential surface of said shaft of said stirring and conveying member, said auxiliary stirring member being movably held in at least one of said segmental stirring chambers.

7. A developing device according to claim 3, wherein said toner gathering port is divided into a plurality of segmental stirring chambers by a plurality of radial plates projecting from the circumferential surface of said shaft of said stirring and conveying member, said auxiliary stirring member being movably held in at least one of said segmental stirring chambers.

8. A developing device according to claim 4, wherein said toner gathering port is divided into a plurality of segmental stirring chambers by a plurality of radial plates projecting from the circumferential surface of said shaft of said stirring and conveying member, said auxiliary stirring member being movably held in at least one of said segmental stirring chambers.

9. A developing device according to claim 5, wherein said toner gathering port is divided into a plurality of segmental stirring chambers by a plurality of radial plates projecting from the circumferential surface of said shaft of said stirring and conveying member, said auxiliary stirring member being movably held in at least one of said segmental stirring chambers.

10. A developing device according to claim 2, said at least one toner gathering port being two or more toner gathering ports, wherein:

each of said toner gathering ports is divided into a plurality of segmental stirring chambers by a plurality of radial plates projecting from the circumferential surface of said shaft of said stirring and conveying member;

at each said toner gathering port, said auxiliary stirring member is movable in at least one of said segmental stirring chambers; and one of said segmental stirring chambers, with said auxiliary stirring member held therein, in an upstream one of said toner gathering ports is located relative to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

11. A developing device according to claim 3, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

12. A developing device according to claim 4, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

13. A developing device according to claim 5, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

14. A developing device according to claim 6, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

15. A developing device according to claim 7, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

16. A developing device according to claim 8, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

17. A developing device according to claim 9, said at least one toner gathering port being two or more toner gathering ports, wherein each of said toner gathering ports is divided into a plurality of segmental stirring chambers by a plurality of radial plates projecting from the circumferential surface of said shaft of said stirring and conveying member, at each said toner gathering port, said auxiliary stirring member is movable in at least one of said segmental stirring chambers, and one of said segmental stirring chambers, with said auxiliary stirring member held therein, in an upstream one of said toner gathering ports is located in respect to one of said segmental stirring chambers, with said auxiliary stirring member held therein, in a downstream one of said toner gathering ports in such a manner that part of the toner passed through said segmental stirring chambers other than said at least one segmental stirring chamber, in which said auxiliary stirring member is held, in said upstream one toner gathering port passes through said at least one segmental stirring chamber, in which said auxiliary stirring member is held, in said downstream one toner gathering port.

18. A developing device according to claim 2, wherein said at least one stirring and conveying member is two or more stirring and conveying members, said toner gathering port being disposed around the circumferential surface of an upstream one of said stirring and conveying members.

19. A developing device according to claim 3, wherein said at least one stirring and conveying member is two or more stirring and conveying members, said toner gathering port being disposed around the circumferential surface of an upstream one of said stirring and conveying members.

20. A developing device according to claim 1, wherein said auxiliary stirring member is spherical.

21. A developing device according to claim 2, wherein said auxiliary stirring member is spherical.

22. A developing device according to claim 3, wherein said auxiliary stirring member is spherical.

23. A developing device according to claim 1, wherein said auxiliary stirring member is cylindrical.

24. A developing device according to claim 2, wherein said auxiliary stirring member is cylindrical.

25. An image forming apparatus comprising:

an image supporting body on which a latent image is to be formed based on given image information;

a toner source;

a developing unit for developing the latent image, which is formed on said image supporting body, into a visible image using a toner delivered from said toner source;

a transferring unit for transferring the toner of the image, which is developed on said image supporting body, onto a medium; and a power source for applying to said developing unit a bias voltage for development;

said developing unit including at least one stirring and conveying member of an electrically conductive material, extending between said toner source and the image supporting body, for conveying a toner from said toner source to the image supporting body longitudinally along a toner delivery path and stirring the toner being conveyed, said stirring and conveying member being electrically charged by a bias voltage to be applied during the developing and hence also serving to charge the toner with electricity during the stirring, at least one toner gathering port, disposed in said toner delivery path, for temporarily halting the toner there during the conveying, at least one auxiliary stirring member of an electrically conductive material, movable in said toner gathering port, for further stirring the toner staying in said gathering port, said auxiliary stirring member being electrically charged by said bias voltage and hence also serving to further charge the toner with electricity during the further stirring, and a stop, disposed at said toner gathering port, for preventing said auxiliary stirring member from moving off said toner gathering port and for allowing the toner to pass through said toner gathering port.

* * * * *